US009415965B2

(12) United States Patent
Hiratsuka et al.

(10) Patent No.: US 9,415,965 B2
(45) Date of Patent: Aug. 16, 2016

(54) MEDIA CONVEYING DEVICE AND MEDIA PROCESSING DEVICE

(71) Applicant: Oki Electric Industry Co., Ltd., Tokyo (JP)

(72) Inventors: Shuuichi Hiratsuka, Tokyo (JP); Yoshiyuki Tosaka, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/652,340

(22) PCT Filed: Nov. 14, 2013

(86) PCT No.: PCT/JP2013/080830

§ 371 (c)(1),
(2) Date: Jun. 15, 2015

(87) PCT Pub. No.: WO2014/097786

PCT Pub. Date: Jun. 26, 2014

(65) Prior Publication Data

US 2015/0298929 A1 Oct. 22, 2015

(30) Foreign Application Priority Data

Dec. 17, 2012 (JP) ..... 2012-274939

(51) Int. Cl.
*G07F 7/04* (2006.01)
*B65H 29/12* (2006.01)

(52) U.S. Cl.
CPC ..... *B65H 29/125* (2013.01); *G07F 7/04* (2013.01); *B65H 2301/5321* (2013.01); *B65H 2402/30* (2013.01); *B65H 2404/1431* (2013.01); *B65H 2601/324* (2013.01); *B65H 2701/1912* (2013.01)

(58) Field of Classification Search
CPC ..... B65H 29/125; B65H 2402/30; B65H 2404/1431; B65H 2601/324; B65H 2701/1912
USPC ..... 194/206, 344
See application file for complete search history.

(56) References Cited

U.S. PATENT DOCUMENTS 5,494,144 A * 2/1996 Izawa ..... G07F 7/04 194/203
6,533,097 B1 3/2003 Sakamoto et al.
2006/0261540 A1* 11/2006 Loiselle ..... B65H 7/08 271/228

FOREIGN PATENT DOCUMENTS

JP S63-212639 A 9/1988
JP 2000-149092 A 5/2000
JP 2010-186448 A 8/2010

*Primary Examiner* — Mark Beauchaine
(74) *Attorney, Agent, or Firm* — Rabin & Berdo, P.C.

(57) ABSTRACT

A media processing device has a roller conveying section having an upper conveying guide that is electrically non-conductive, and forms one side surface of a bank note conveying path, and has an internal space; a frame that is electrically conductive and holds the upper conveying guide; a pushing spring that applies pushing force that urges pushing rollers toward driving rollers; and a supporting point shaft that is electrically conductive, and whose position in a front-rear direction is positioned by the upper conveying guide in vicinities of both end portions in a length direction of the supporting point shaft, and that supports the pushing spring in a vicinity of a central portion in the length direction, and that abuts laterally long upper end surfaces of the frame by receiving reaction force that arises in a direction of separating from the bank note conveying path in accordance with the pushing force.

11 Claims, 21 Drawing Sheets

MEDIA CONVEYING DEVICE AND MEDIA PROCESSING DEVICE

TECHNICAL FIELD

The present invention relates to a media conveying device and a media processing device, and is suitable for application to, for example, a bank note processing device in which media such as cash or the like are inserted and that carries out a desired transaction, or the like.

BACKGROUND ART

Conventionally, at bank note processing devices and the like that are used in financial institutions or the like, for example, a client deposits cash such as bank notes or coins or the like, or cash is dispensed to the client, in accordance with the contents of the transaction with the client.

There are bank note processing devices that have, for example, a bank note deposit/withdrawal opening that carries out the transfer of bank notes to and from clients, a discriminating section that discriminates the denomination and the authenticity of an inserted bank note, a temporary holding section that temporarily holds inserted bank notes, and denomination cassettes that store bank notes per denomination.

This bank note processing device conveys bank notes by connecting the respective sections, that are the bank note deposit/withdrawal opening, the discriminating section, the temporary holding section, the denomination cassettes and the like, by a conveying path that is provided at the interior of a housing (see, for example, Japanese Patent Application Laid-Open (JP-A) No. 2010-186448).

A roller conveying section 220, that conveys bank notes by the mechanisms shown in FIG. 18 to FIG. 21, is used as a portion of the conveying path in such a bank note processing device.

FIG. 18 shows the roller conveying section 220 seen from the right side of a frame right side plate 19R, and FIG. 19 shows the roller conveying section 220 seen from the right side through the frame right side plate 19R, an upper guide right side plate 44R and a lower guide right side plate 46R. In FIG. 19, the frame right side plate 19R and the upper guide right side plate 44R are shown virtually by the two-dot chain lines.

FIG. 20 shows the roller conveying section 220 seen from the front side of an upper guide front side plate 44F and a lower guide front side plate 46F. FIG. 21 shows the roller conveying section 220 seen from the front side through the upper guide front side plate 44F and the lower guide front side plate 46F.

At this roller conveying section 220, an upper conveying unit 262 in which plural mechanism parts are combined is made into a sub-assembly. The roller conveying section 220 is assembled due to this upper conveying unit 262 that has been assembled in advance being fit into a frame 19.

The frame right side plate 19R and a frame left side plate 19L, that are plate-shaped and are formed of metal, extend along the vertical direction at the left and right end portions of the roller conveying section 220. Hereinafter, the frame right side plate 19R and the frame left side plate 19L are also collectively called the frame 19.

An outer side metal plate 16 that covers the upper conveying unit 262 from above is mounted to the frame 19. The outer side metal plate 16 is structured by a metal plate, and is bent downward at the four corners of a shape that is rectangular as seen in plan view and extends in the horizontal direction, and is electrically conductive with the frame 19 by being fixed to the frame 19.

An inner side metal plate 17 that is structured by a metal plate is provided beneath the outer side metal plate 16. At this inner side metal plate 17, the left and right end portions of an inner side metal plate ceiling plate 17J that extends in the horizontal direction are bent downward substantially orthogonally, and structure an inner side metal plate right side plate 17R and an inner side metal plate left side plate 17L.

Due to the inner side metal plate ceiling plate 17U being fixed to the outer side metal plate 16, this inner side metal plate 17 is electrically conductive with the outer side metal plate 16 and holds an upper conveying guide 44.

A bank note conveying path 48, at which bank notes are conveyed with the upper side and lower side thereof being guided respectively by the upper conveying guide 44 and a lower conveying guide 46 that are plate-shaped and whose left and right end portions are held at the frame 19, is formed at this roller conveying section 220.

It is easy to see the interior of the bank note conveying path 48 from the exterior due to this upper conveying guide 44 being resin-molded and formed to be transparent.

The roller conveying section 220 has drive rollers 26 that are provided so as to rotate freely, and pushing rollers 30 that are formed of metal and push the bank notes against the drive rollers 26 in a direction orthogonal to the surface direction that is the direction in which the surfaces of the bank notes extend.

The pushing rollers 30 rotate around pushing shafts 32 that are made of metal, and are electrically conductive with the inner side metal plate 17 due to these pushing shafts 32 being slidably inserted and fit into pushing shaft hole portions 76 that are formed in the inner side metal plate right side plate 17R and the inner side metal plate left side plate 17L.

The pushing shafts 32 are urged downward by a pushing spring 38 that is made of metal. This pushing spring 38 is supported by a supporting point shaft 236.

The supporting point shaft 236 is cylindrical, is formed of metal, and extends in the left-right direction. The supporting point shaft 236 is electrically conductive with the inner side metal plate 17 by being fit into and fixed to supporting point shaft hole portions 74 that are formed in the inner side metal plate right side plate 17R and the inner side metal plate left side plate 17L.

The supporting point shaft 236 is pushed against the upper end surfaces of the supporting point shaft hole portions 74 due to reaction force that is generated toward an upward direction in accordance with the pushing force that the pushing spring 38 applies to the pushing shafts 32.

This roller conveying section 220 is made into a sub-assembly as the upper conveying unit 262 in a state in which the upper conveying guide 44, and the pushing rollers 30, the pushing shafts 32, the pushing spring 38 and the supporting point shaft 236 that are mechanism parts within this upper conveying guide 44, and the inner side metal plate 17 and the outer side metal plate 16 are made integral. The roller conveying section 220 is assembled due to the outer side metal plate 16 being fixed to the frame 19.

By the way, the pushing rollers 30, the pushing shafts 32, the pushing spring 38 and the supporting point shaft 236, that are charged because they are made of metal, must be connected to the frame 19 by conductors through which electricity flows, as a countermeasure to erroneous operation and noise that are due to static electricity.

However, the upper conveying guide 44 is a transparent, resin-molded product and is not electrically conductive.

Therefore, at the roller conveying section 220, the mechanism parts within the upper conveying guide 44 cannot be made to be electrically conductive with the frame 19 via the upper conveying guide 44.

Therefore, at the roller conveying path 220, although the upper conveying unit 262 is made into a sub-assembly, the mechanism parts within the upper conveying guide 44 can be made to be electrically conductive all the way to the frame 19 by holding the supporting point shaft 236 at the inner side metal plate 17, and fixing the inner side metal plate 17 to the outer side metal plate 16, and further, fixing the outer side metal plate 16 to the frame 19.

SUMMARY OF INVENTION

Technical Problem

At the roller conveying section 220, the number of the mechanism parts, that are made of metal and are disposed within the upper conveying guide 44 at the upper conveying unit 262 that has been made into a sub-assembly, that are made to be conductive all the way to the frame 19 as a countermeasure to static electricity, is large, and the structure becomes complex.

The present invention proposes a media conveying device and a media processing device that may be easily assembled while maintaining electrical conductivity in a simple structure.

Solution to Problem

A first aspect of the present invention is a media conveying device including: a conveying guide that is electrically non-conductive, that forms one side surface of a conveying path at which media are conveyed along a surface direction, and that has an internal space; a frame that is electrically conductive and holds the conveying guide; pushing rollers, provided in the internal space of the conveying guide, which convey the media, by nipping a media between the pushing rollers and driving rollers that face the pushing rollers with the conveying path therebetween, and by rotating; a pushing roller urging portion that applies pushing force that urges the pushing rollers toward the driving rollers; and a supporting point shaft that is electrically conductive, and whose position in a first direction, that is substantially orthogonal to a length direction of the supporting point shaft and a direction of the pushing force, is positioned by the conveying guide in vicinities of both end portions in the length direction, and that supports the pushing roller urging portion in a vicinity of a central portion in the length direction, and that abuts supporting point shaft abutment portions of the frame by receiving reaction force that arises in a direction of separating from the conveying path in accordance with the pushing force.

In the first aspect of the present invention, although the conveying unit, in which at least the conveying guide, the pushing rollers, the pushing roller urging portion and the supporting point shaft are made integral, is made into a sub-assembly, the parts at the interior of this conveying unit may be made to be conductive with the frame that is at the exterior.

A second aspect of the present invention is a media processing device including: an operation section that receives operations relating to a paper-sheet-like media; a conveying path that conveys the media along a surface direction in accordance with operation of the operation section; a conveying guide that is electrically non-conductive, and that forms one side surface of the conveying path, and that has an internal space; a frame that is electrically conductive and holds the conveying guide; pushing rollers, provided in the internal space of the conveying guide, that convey the media, by nipping the media between the pushing rollers and driving rollers that face the pushing rollers with the conveying path therebetween, and by rotating; a pushing roller urging portion that applies pushing force that urges the pushing rollers toward the driving rollers; and a supporting point shaft that is electrically conductive, and whose position in a direction, that is substantially orthogonal to a length direction of the supporting point shaft and a direction of the pushing force, is positioned by the conveying guide in vicinities of both end portions in the length direction, and that supports the pushing roller urging portion in a vicinity of a central portion in the length direction, and that abuts supporting point shaft abutment portions of the frame by receiving reaction force that arises in a direction of separating from the conveying path in accordance with the pushing force.

In the second aspect of the present invention, although the conveying unit, in which at least the conveying guide, the pushing rollers, the pushing roller urging portion and the supporting point shaft are made integral, is made into a sub-assembly, the parts at the interior of this conveying unit may be made to be conductive with the frame that is at the exterior.

Advantageous Effects of Invention

In accordance with the above-described aspects of the present invention, although the conveying unit, in which at least the conveying guide, the pushing rollers, the pushing roller urging portion and the supporting point shaft are made integral, is made into a sub-assembly, the parts at the interior of this conveying unit may be made to be conductive with the frame that is at the exterior. Thus, the above-described aspects of the present invention may realize a media conveying device and a media processing device that may be easily assembled while maintaining electrical conductivity in a simple structure.

DESCRIPTION OF EMBODIMENTS

Embodiments for implementing the present invention (hereinafter called exemplary embodiments) are described in detail hereinafter by using the drawings.

1. First Exemplary Embodiment

1-1. External Structure of Bank Note Processing Device

Figure 1:
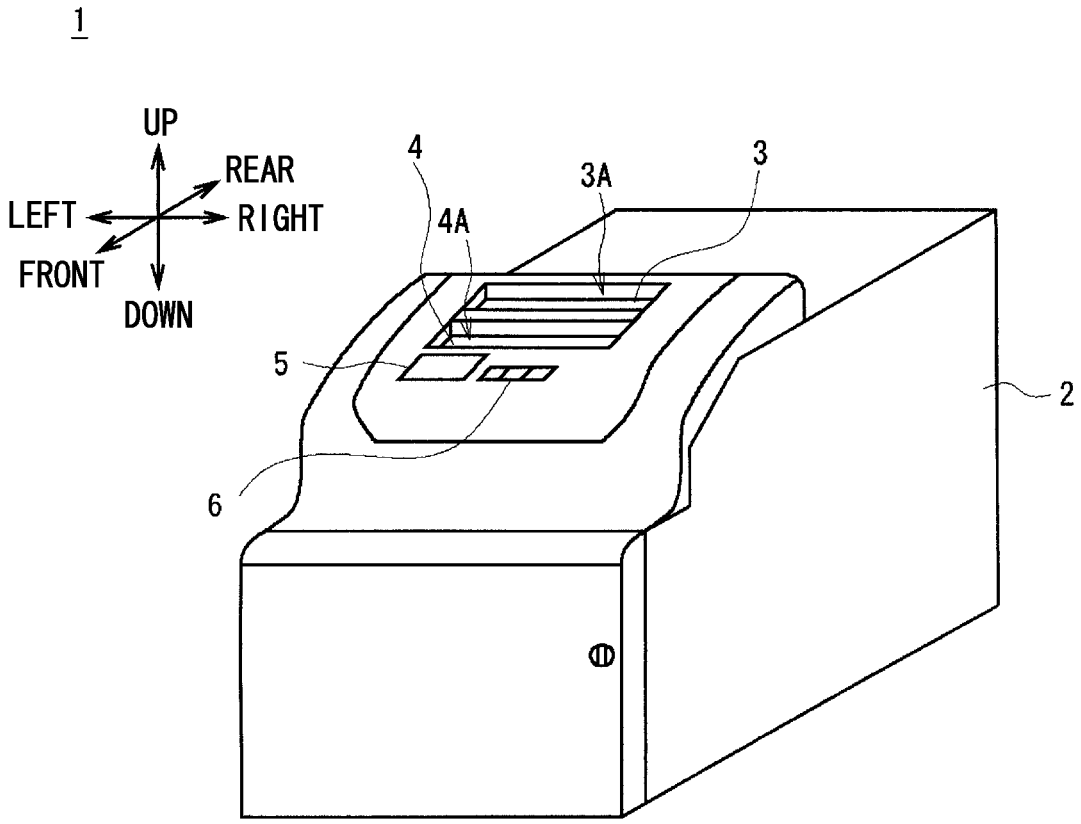
FIG. 1 is a perspective view showing the external structure of a bank note processing device.

As shown in FIG. 1, a bank note processing device 1 is a bank clerk operated terminal that a bank clerk of a financial institution (e.g., a clerk at the reception counter) operates, and carries out deposit/withdrawal processing of bank notes on the basis of operations of the bank clerk.

At this bank note processing device 1, an insertion opening 3A of a deposit section 3, a dispense opening 4A of a withdrawal section 4, a display section 5 and an operation section 6 are provided at the upper end portion of a housing 2 that is box-shaped.

When bank notes to be deposited are inserted in from the insertion opening 3A by the bank clerk, the deposit section 3 separates these bank notes one-by-one and takes the bank notes into the interior of the bank note processing device 1.

The withdrawal section 4 stacks bank notes to be withdrawal, and has the bank clerk take the bank notes out from the dispense opening 4A. Further, a shutter (not shown) that opens and closes the dispense opening 4A is provided at the withdrawal section 4, and opens at the time of dispensing the bank notes.

The display section 5 is structured by a liquid crystal display, and displays menu screens, screens of the results of various types of processings, and the like. The operation section 6 is structured by push buttons, and receives operations with respect to the bank note processing device 1.

Moreover, although not illustrated, the bank note processing device 1 may communicate with terminals or the host computer of the financial institution via a network, and may transmit and receive various types of information to and from the terminals and host computer, and may be operated from the terminal sides.

1-2. Internal Structure of Bank Note Processing Device

Figure 2:
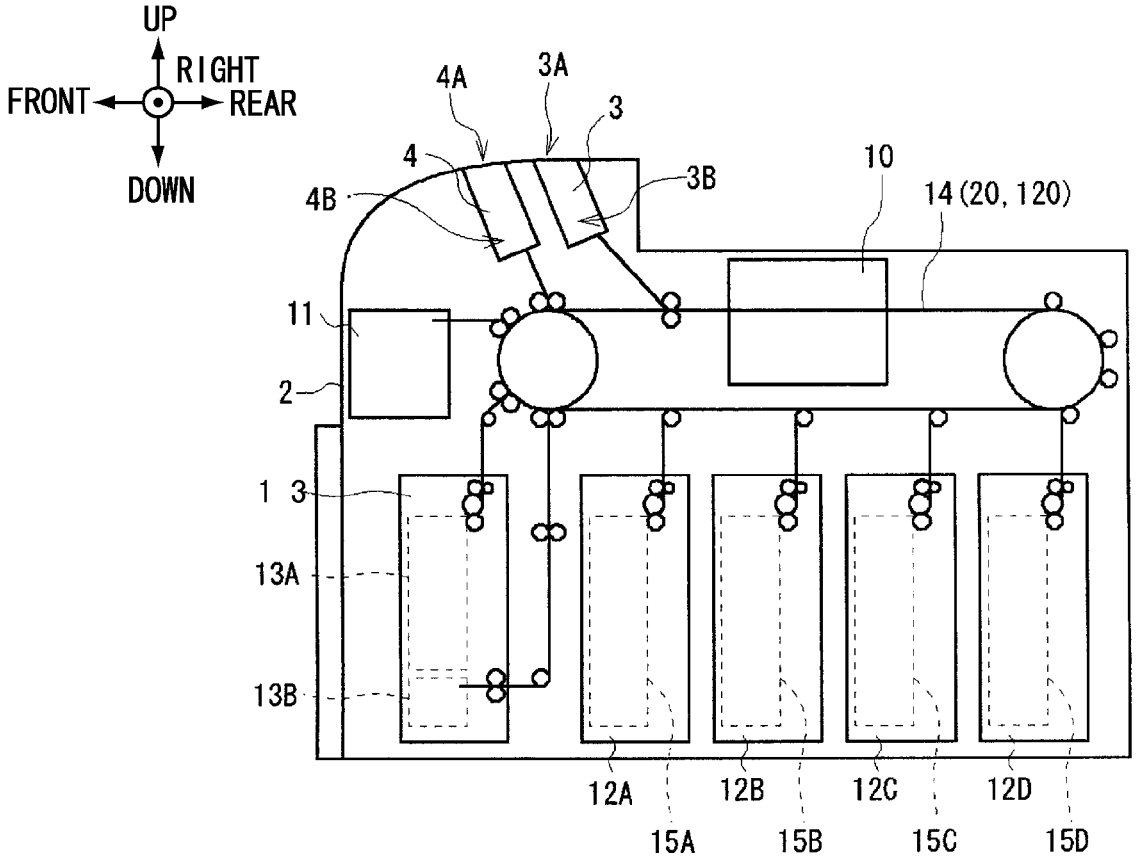
FIG. 2 is a right side view showing the internal structure of the bank note processing device.

As shown in FIG. 2, in addition to the above-described deposit section 3 and withdrawal section 4, a discriminating section 10, a temporary holding section 11, bank note cassettes 12A to 12D, a bank note cassette 13 with a reject container, and a conveying path 14 are provided within the housing 2 of the bank note processing device 1.

At the upper portion of the housing 2 interior, the deposit section 3 and the withdrawal section 4 are provided so as to be lined-up in the front-rear direction such that the deposit section 3 is at the rear side and the withdrawal section 4 is at the front side. Further, the temporary holding section 11 is provided obliquely downward to the front of the withdrawal section 4. The discriminating section 10 is provided further toward the rear than the temporary holding section 11, and obliquely downward to the rear of the deposit section 3.

Moreover, the bank note cassettes 12A to 12D and the bank note cassette 13 with a reject container are provided at the lower portion of the housing 2 interior, to as to be lined-up in the front-rear direction.

At this bank note processing device 1, the bank note cassette 13 with a reject container is at the front-most side, and, to the rear thereof, the bank note cassettes 12A to 12D are provided so as to be lined-up in the order of the bank note cassettes 12A, 12B, 12C, 12D.

Moreover, the conveying path 14, that connects these respective sections that are the deposit section 3, the withdrawal section 4, the discriminating section 10, the temporary holding section 11, the bank note cassettes 12A to 12D and the bank note cassette 13 with a reject container, is provided within the housing 2. The conveying path 14 conveys the bank notes along the short-side direction.

The conveying path 14 is structured by plural belt conveying sections and a roller conveying section 20 that is described later. At the belt conveying section, two sets of tapes, that are trained around pairs of rollers that are disposed so as to face one another and that circulate between the rollers, are provided, and the bank notes are nipped and conveyed from the both surface sides thereof by the two sets of tapes.

Mainly, the roller conveying section 20 is provided between belt conveying sections that are adjacent to one another, or, the roller conveying sections are provided adjacent to one another. The roller conveying section 20 nips and conveys bank notes by pushing rollers and driving rollers that are described later.

The deposit section 3 has a storage section 3B that is shaped as a box and whose top surface is open. A portion of the opening of the storage section 3B is the aforementioned insertion opening 3A. At the time of a deposit transaction, the deposit section 3 separates one-by-one the bank notes to be deposited that have been inserted into the storage section 3B from the insertion opening 3A, and takes the bank notes into the interior of the bank note processing device 1.

The withdrawal section 4 has a stacking portion 4B that is shaped as a box and whose top surface is open. The opening of this stacking portion 4B is the aforementioned discharge opening 4A. At the time of a withdrawal transaction, the withdrawal section 4 stacks, in the stacking portion 4B, the bank notes to be dispensed that have been conveyed-in from the bank note cassettes 12A to 12D and the like.

Further, a shutter (not illustrated) for opening and closing the dispense opening 4A is provided at the withdrawal section 4. This shutter opens after the bank notes to be dispensed have been stacked in the stacking portion 4B. Due to the shutter opening, the bank clerk can take the bank notes to be dispensed, that are stacked in the stacking portion 4B, out from the dispense opening 4A.

The deposit section 3 and the withdrawal section 4 are fixed in states of being inclined forward such that the upper end portions thereof are positioned further forward than the lower end portions thereof. Note that the deposit section 3 and the withdrawal section 4 are not limited to such fixed types, and may be, for example, movable types whose slopes in the front-rear direction can be adjusted.

The discriminating section 10 discriminates the denomination, the authenticity, the undamaged/damaged state, the travelling state, and the like of the bank notes that are conveyed-in one-by-one via the conveying path 14. This discriminating section 10 determines, per bank note and on the basis of the results of discrimination thereof, whether a bank note is a normal bank note that can be handled or is a reject bank note that cannot be handled.

The temporary holding section 11 temporarily stacks the bank notes that have been taken-in from the deposit section 3 and have been determined by the discriminating section 10 as being normal bank notes. After a transaction is established, the bank notes that are stacked in the temporary holding section 11 are sent-out from the temporary holding section 11 and conveyed to the discriminating section 10, and, after the denominations thereof are specified by the discriminating section 10, the bank notes are conveyed to and stored in the bank note cassettes 12A to 12D.

The respective bank note cassettes 12A to 12D have bank note storage containers 15A to 15D that are vertically long and can accommodate bank notes per denomination, and stack the bank notes, that are conveyed-in via the conveying path 14, in piles in the top-bottom direction at the interiors of these bank note storage containers 15A to 15D.

Further, the bank note cassettes 12A to 12D not only store bank notes, but also can send the bank notes, that are stacked within the bank note storage containers 15A to 15D, out to the conveying path 14 one-by-one. Moreover, the bank note cassettes 12A to 12D are removable types that can be individually installed in and removed from the bank note processing device 1.

The bank note cassette 13 with a reject container has a bank note storage container 13A at the upper side thereof and a reject container 13B at the lower side thereof. This bank note cassette 13 with a reject container also is a removable type that can be installed in and removed from the bank note processing device 1.

In this bank note cassette 13 with a reject container, for example, bank notes, that are sent-out from the bank notes cassettes 12A to 12D at the time of collecting bank notes, are stored in the bank note storage container 13A. Thereafter, the bank notes are collected by a bank clerk removing the bank note cassette 13 with a reject container from the bank note processing device 1.

Further, at the time of replenishing bank notes, the bank clerk sets the bank note cassette 13 with a reject container, in which bank notes to be replenished are stored in the bank note storage container 13A, in the bank note processing device 1. Thereafter, the bank notes to be replenished that are stored in the bank note storage container 13A are sent-out from the bank note cassette 13 with a reject container, and go through the discriminating section 10, and are conveyed to and replenished into the bank note cassettes 12A to 12D. The replenishing of bank notes is carried out in this way at the bank note processing device 1.

In this way, the bank note storage container 13A of the bank note cassette 13 with a reject container can be used for plural applications.

Further, the reject container 13B of the bank note cassette 13 with a reject container stacks the bank notes that have been determined as being reject bank notes by the discriminating section 10.

Further, a control section (not shown) that controls the entire bank note processing device 1 is provided at a predetermined place within the housing 2 of the bank note processing device 1.

With this structure, at the bank note processing device 1, the control section controls the respective sections on the basis of the results of discrimination of bank notes by the discriminating section 10, and the like, and carries out deposit processing or withdrawal processing of bank notes.

Namely, at the bank note processing device 1, at the time of a deposit transaction, when deposit transaction is selected by the bank clerk via the operation section 6, and further, bank notes are inserted into the deposit section 3 from the insertion opening 3A, the inserted bank notes are conveyed one-by-one to the discriminating section 10.

Here, the bank note processing device 1 conveys bank notes, that have been determined by the discriminating section 10 as being normal bank notes, to the temporary holding section 11 and stores the bank notes temporarily. On the other hand, the bank note processing device 1 returns bank notes, that have been determined as being deposit reject bank notes that are unsuited for depositing, to the withdrawal section 4, and, by opening the shutter, returns the bank notes to the bank clerk.

Thereafter, when the deposit amount is confirmed by the bank clerk, the bank note processing device 1 conveys the bank notes, that are stored in the temporary holding section 11, to the discriminating section 10 and discriminates the denominations, and, in accordance with the denominations thereof, conveys the bank notes to and stores the bank notes in the respective bank note cassettes 12A to 12D.

On the other hand, at time of a withdrawal transaction, when withdrawal transaction is selected and the amount to be dispensed and the like are inputted by the bank clerk via the operation section 6, the bank note processing device 1 identifies the number of bank notes of each denomination that is needed in accordance with the requested amount, and sends the bank notes out one-by-one from the respective bank note cassettes 12A to 12D in accordance with the number of bank notes per denomination, and conveys the bank notes to the discriminating section 10.

Here, the bank note processing device 1 conveys bank notes, that are determined by the discriminating section 10 as being normal bank notes, to the withdrawal section 4. On the other hand, the bank note processing device 1 conveys bank notes, that are determined as being withdrawal reject bank notes that are unsuitable for withdrawal, to the temporary holding section 11 and temporarily stores the bank notes.

Then, when the bank notes of the requested amount are stacked in the withdrawal section 4, the bank note processing device 1 opens the shutter. Due thereto, there becomes a state in which receipt of the bank notes that are stacked within the withdrawal section 4 is possible, and the bank clerk accepts the bank notes.

Thereafter, the bank note processing device 1 conveys the withdrawal reject bank notes, that are stored in the temporary holding section 11, to the reject container 13B of the bank note cassette 13 with a reject container, and stores them therein.

In this way, the bank note processing device 1 carries out depositing processing and withdrawal processing of bank notes.

1-3. Structure of Roller Conveying Section

The roller conveying section 20 in accordance with the first exemplary embodiment is illustrated in FIG. 3 to FIG. 6 in which the same reference numerals are given to the portions corresponding to FIG. 18 to FIG. 21.

Figure 3:
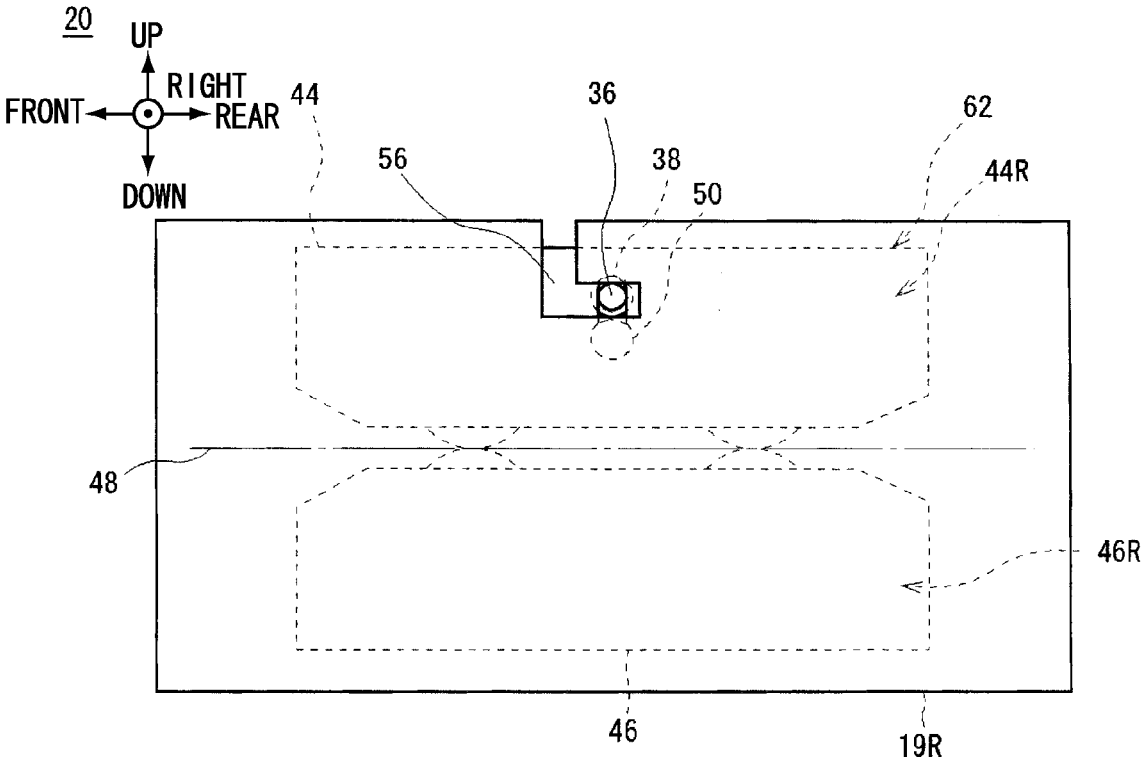
FIG. 3 is a right side view showing structure (1) of a roller conveying section in accordance with a first exemplary embodiment.
Figure 4:
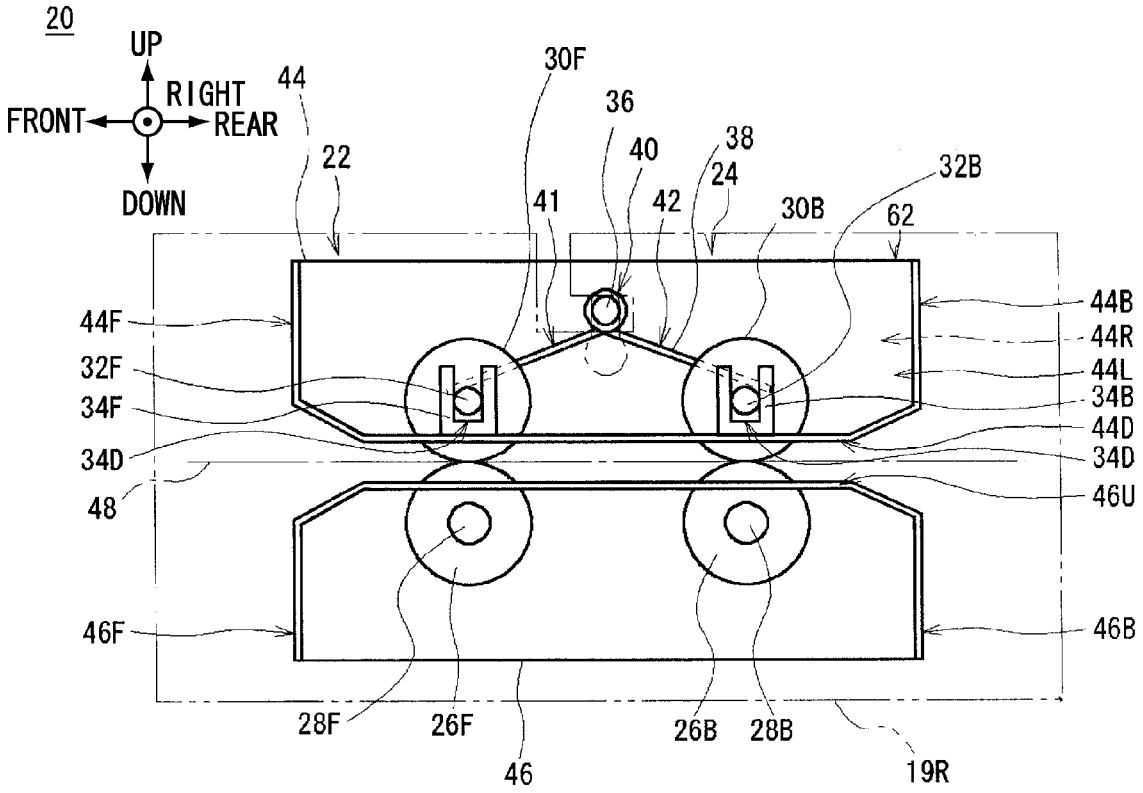
FIG. 4 is a right side view showing structure (2) of the roller conveying section in accordance with the first exemplary embodiment.

FIG. 3 shows the roller conveying section 20 seen from the right side of the frame right side plate 19R, and FIG. 4 shows the roller conveying section 20 seen from the right side through the frame right side plate 19R, the upper guide right side plate 44R and the lower guide right side plate 46R. In FIG. 4, the frame right side plate 19R and the upper guide right side plate 44R are shown virtually by the two-dot chain lines.

Figure 5:
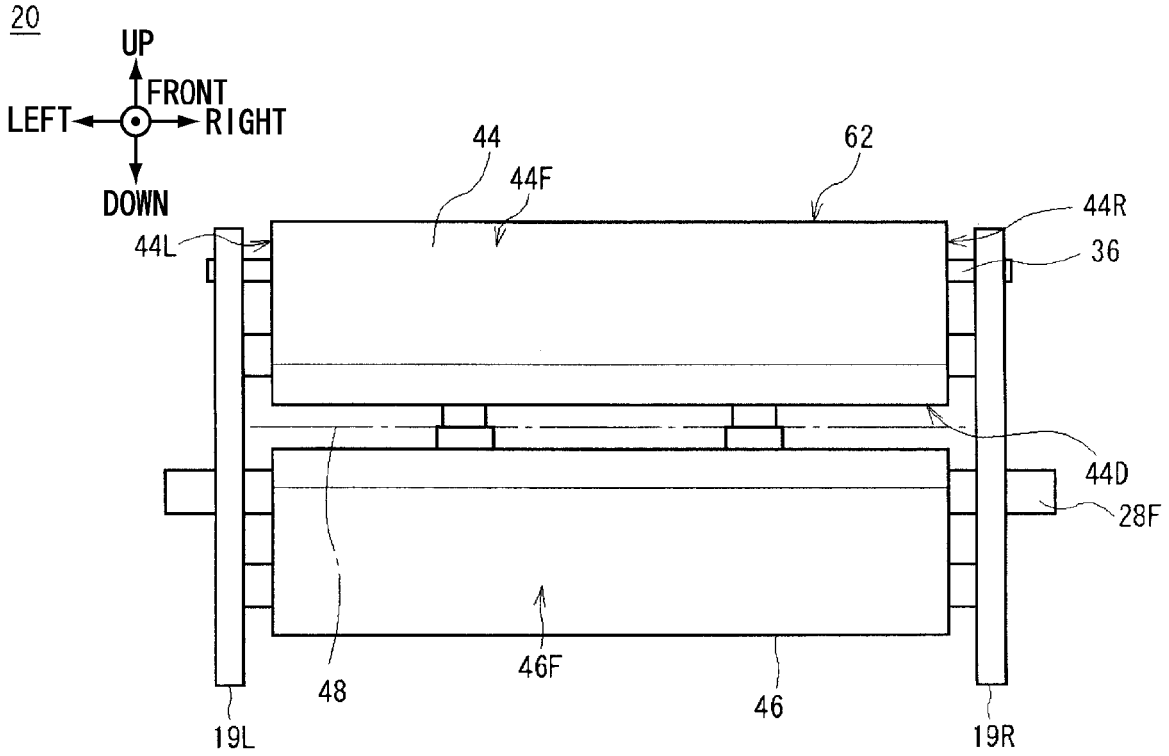
FIG. 5 is a front view showing structure (3) of the roller conveying section in accordance with the first exemplary embodiment.
Figure 6:
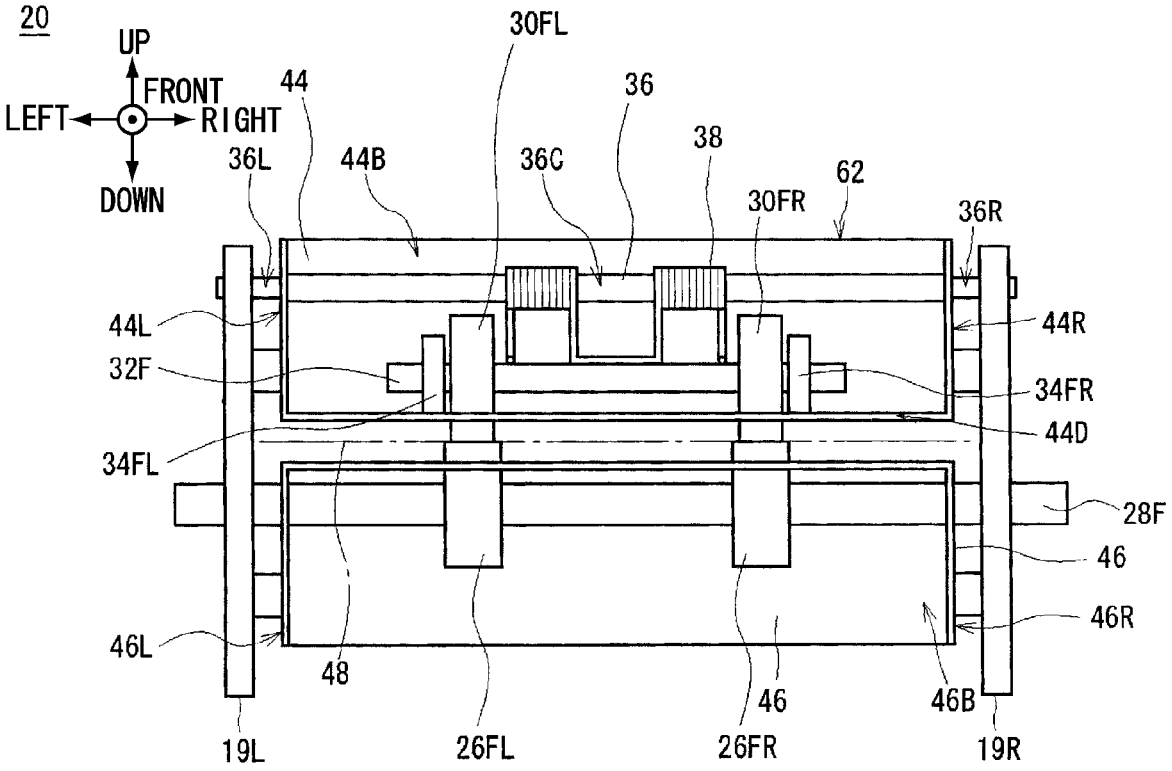
FIG. 6 is a front view showing structure (4) of the roller conveying section in accordance with the first exemplary embodiment.

FIG. 5 shows the roller conveying section 20 seen from the front side of the upper guide front side plate 44F and the lower guide front side plate 46F. FIG. 6 shows the roller conveying section 20 seen from the front side through the upper guide front side plate 44F and the lower guide front side plate 46F.

At this roller conveying section 20, an upper conveying unit 62 in which plural mechanism parts are combined is made into a sub-assembly. At the time of manufacturing the bank note processing device 1, the roller conveying section 20 is assembled due to the upper conveying unit 62 that has been assembled in advance being fit into the frame 19.

As shown in FIG. 4, the roller conveying section 20 is structured by a front side conveying section 22 and a rear side conveying section 24. Because the front side conveying section 22 and the rear side conveying section 24 are formed substantially similarly to one another, hereinafter, mainly the front side conveying section 22 is described.

At the roller conveying section 20, the front side conveying section 22, that is formed from driving rollers 26F, pushing rollers 30F, pushing roller rails 34F and the like, and the rear side conveying section 24, that is formed from driving rollers 26B, pushing rollers 30B, pushing roller rails 34B and the like, are disposed so as to have front-rear symmetry (left-right symmetry in the drawing) across a supporting point shaft 36 that is made of metal. Hereinafter, the driving rollers 26F and 26B are collectively called the driving rollers 26, the pushing rollers 30F and 30B are collectively called the pushing rollers 30, and the pushing roller rails 34F and 34B are collectively also called the pushing roller rails 34.

The bank note conveying path 48, at which bank notes are conveyed with the upper side and lower side thereof being guided respectively by the upper conveying guide 44 and the lower conveying guide 46, is formed at this roller conveying section 20.

The upper conveying guide 44, that is formed in a plate shape and is resin molded and is transparent, is provided at the upper side of the bank note conveying path 48.

At the upper conveying guide 44, the left and right end portions of an upper guide bottom plate 44D, that extends along the horizontal direction toward the front and rear and left and right in a vicinity of the lower end portions of the pushing rollers 30, are bent upward, and an upper guide left side plate 44L and the upper guide right side plate 44R are respectively formed. Further, the front and rear end portions of the upper guide bottom plate 44D are bent upward, and the upper guide front side plate 44F and an upper guide rear side plate 44B are respectively formed.

Due thereto, the upper conveying guide 44 has, at the upper side of the upper guide bottom plate 44D, an interior space in which mechanism parts are disposed.

Due to openings (not shown) being formed in the upper guide bottom plate 44D at positions facing the pushing rollers 30, the lower end portions of the pushing rollers 30 project-out to the lower side of the upper guide bottom plate 44D.

On the other hand, the lower conveying guide 46, that is formed in a plate shape and is formed from a metal plate and is not transparent, is provided at the lower side of the bank note conveying path 48. At the lower conveying guide 46, the front, rear, left and right end portions of a lower guide ceiling plate 46U, that extends parallel to the upper guide conveying plate 44D in a vicinity of the upper end portions of the driving rollers 26, are bent downward, and the lower guide front side plate 46F, a lower guide rear side plate 46B, the lower guide right side plate 46R and a lower guide left side plate 46L are respectively formed.

Due to openings (not shown) being formed in the lower guide ceiling plate 46U at positions facing the driving rollers 26, the upper end portions of the driving rollers 26 project-out to the upper side of the lower guide ceiling plate 46U.

The bank note conveying path 48, at which a bank note that has been conveyed-in from a belt conveying section or a roller conveying section that is a portion of the conveying path 14 (FIG. 2) is conveyed from front to rear or from rear to front, is formed in the space of the gap between the upper conveying guide 44 and the lower conveying guide 46 at the roller conveying section 20.

The frame right side plate 19R and the frame left side plate 19L, that are plate-shaped and made of metal, extend along the vertical direction at the outer sides in the left-right direction of the upper conveying guide 44 and the lower conveying guide 46, and are fixed to the housing 2 (FIG. 2). Hereinafter, the frame right side plate 19R and the frame left side plate 19L are also collectively called the frame 19.

The left and right end portions of the upper conveying guide 44 and the lower conveying guide 46 are held at the frame 19.

In this way, the roller conveying section 20 restricts the range of conveying of a bank note at the bank note conveying path 48, by the upper conveying guide 44, the lower conveying guide 46 and the frame 19.

At the lower portion of the front side conveying section 22, the two driving rollers 26F (26FL and 26FR) that are made of metal are provided so as to be lined-up left and right with a gap therebetween that is shorter than the length of the bank notes in the long-side direction, so as to rotate freely clockwise and counterclockwise in FIG. 4 with a driving roller shaft 28F, that is cylindrical and made of metal and is mounted to the frame 19 along the left-right direction, being the shaft.

The pushing rollers 30F (30FL and 30FR) that are made of metal are provided at the upper portions of the respective driving rollers 26F so as to face the driving rollers 26F. The two pushing rollers 30F are provided so as to be lined-up left and right and so as to rotate freely clockwise and counterclockwise in FIG. 4 with a pushing shaft 32F, that is cylindrical and made of metal and extends in the left-right direction, being the shaft. Therefore, the pushing rollers 30F and the pushing shaft 32F are electrically conductive.

The pushing roller rails 34F (34FR and 34FL), that are transparent and are resin molded such that the upper portions thereof are open, are provided integrally with the upper conveying guide 44 at the right side of the pushing roller 30FR and the left side of the pushing roller 30FL.

The opening width in the front-rear direction of the pushing roller rails 34F is formed to be slightly larger than the front-rear width of the pushing shaft 32F. Due thereto, the pushing roller rails 34F cause the pushing shaft 32F to slide in the vertical direction.

The rear side conveying section 24 is structured similarly to this front side conveying section 22, at the rear side of the supporting point shaft 36.

The supporting point shaft 36 is cylindrical and formed of metal and extends in the left-right direction. A supporting point shaft right end portion 36R that is the right end portion and a supporting point shaft left end portion 36L that is the left end portion are formed so as to be narrower than a supporting point shaft central portion 36C that is the central portion in the left-right direction.

Figure 7:
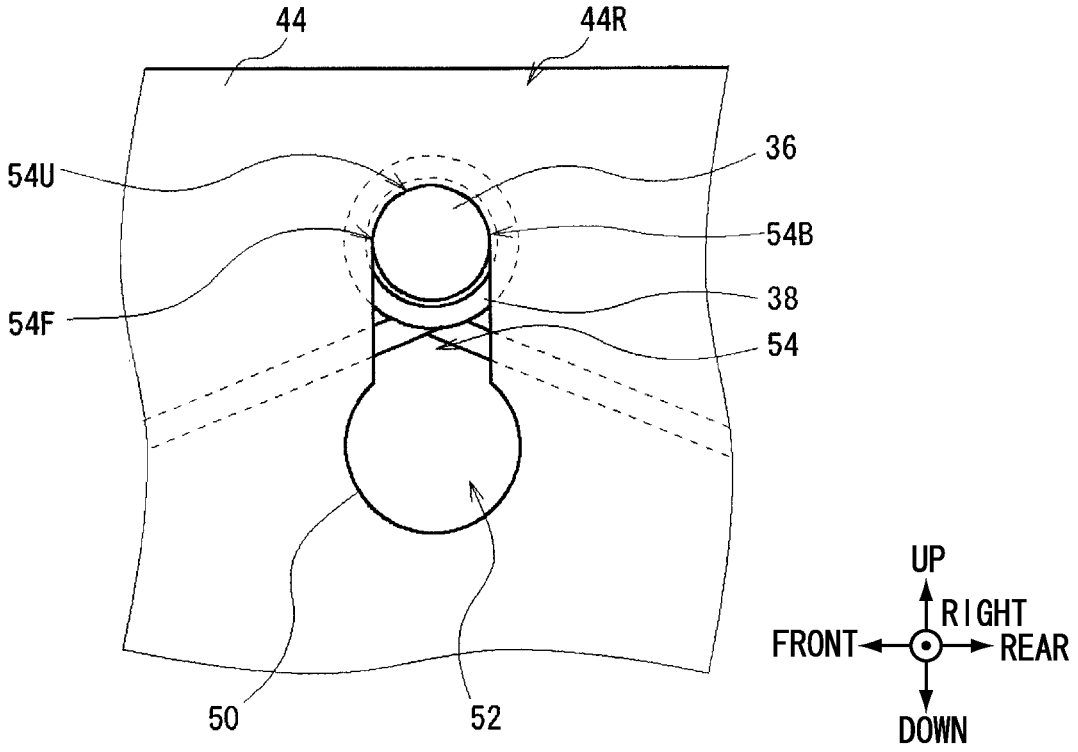
FIG. 7 is a right side view showing the structure of a guide hole portion in accordance with the first exemplary embodiment.

Guide hole portions 50, that are shown in FIG. 7 and are substantially gourd-shaped, are formed in the upper guide left side plate 44L and the upper guide right side plate 44R at positions facing the supporting point shaft 36.

At the guide hole portion 50, an insertion hole portion 52 that is round is formed at the lower portion, and a fit-in hole portion 54, whose width in the front-rear direction is slightly smaller than that of the insertion hole portion 52, is formed at the upper side of the insertion hole portion 52. A fit-in upper end surface 54U, that curves substantially the same as the outer peripheral surface of the supporting point shaft 36, is formed at the upper end portion of the fit-in hole portion 54, and a fit-in rear end surface 54B is formed at the rear end portion of the fit-in hole portion 54, and a fit-in front end surface 54F is formed at the front end portion of the fit-in hole portion 54, respectively.

By forming the widths of the fit-in hole portions 54 in the front-rear direction to be slightly larger than the outer shapes of the supporting point shaft left end portion 36L and the supporting point shaft right end portion 36R of the supporting point shaft 36, there is a structure in which the supporting point shaft 36 can be inserted through the interiors.

Figure 8:
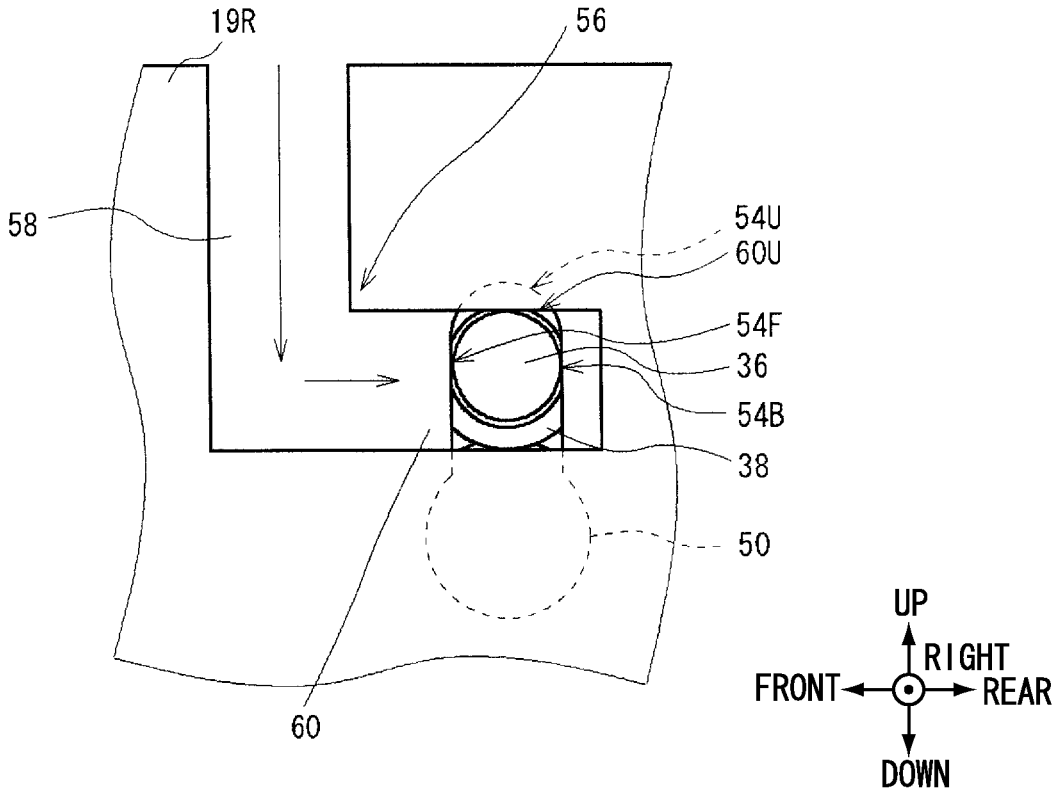
FIG. 8 is a right side view showing the structures of a supporting point shaft, the guide hole portion and a frame hole portion in accordance with the first exemplary embodiment.

Further, frame hole portions 56, that are shown in FIG. 8 and are L-shaped, are formed in the frame 19 at positions facing the supporting point shaft 36.

This frame hole portion 56 is structured from a vertically long hole portion 58 that is cut-out downward from the upper end of the frame 19, and a laterally long hole portion 60 at which the frame 19 is cut-out toward the rear from the lower end of the vertically long hole portion 58.

A laterally long upper end surface 60U, that is the top surface of the laterally long hole portion 60, is positioned slightly further downward than the fit-in upper end surface 54U of the fit-in hole portion 54 at the guide hole portion 50.

The supporting point shaft left end portion 36L and the supporting point shaft right end portion 36R of the supporting point shaft 36 are inserted through the guide hole portions 50, and are inserted into and fixed to the frame hole portions 56. Due thereto, the supporting point shaft 36 is electrically conductive with the frame 19.

Further, at the supporting point shaft 36, the right side surface of the supporting shaft central portion 36C abuts the left side surface of the upper guide right side plate 44R, and the left side surface of the supporting point shaft central portion 36C abuts the right side surface of the upper guide left side plate 44L.

Due thereto, positional offset, in the left-right direction, of the supporting point shaft 36 with respect to the upper conveying guide 44 is restricted.

As shown in FIG. 4 and FIG. 6, a wound portion 40, that is the central portion in the front-rear direction of a single metal rod at the pushing spring 38 that is a torsion spring made of metal, is wound on the supporting point shaft 36. A front arm portion 41 that is a portion of the torsion spring extends in the frontward direction from the wound portion 40, and a rear arm portion 42 extends in the rearward direction, respectively.

At the pushing spring 38, in the state in which the front end portion of the front arm portion 41 and the rear end portion of the rear arm portion 42 are positioned further upward than the natural state, the front end portion of the front arm portion 41 and the rear end portion of the rear arm portion 42 abut and are electrically conductive with the upper end of the pushing shaft 32F and the upper end of a pushing shaft 32B, respectively.

Therefore, at the pushing spring 38, due to the repulsive force that attempts to return the pushing spring 38 to its natural state, the front arm portion 41 applies pushing force, that is urging force in the downward direction, to the pushing shaft 32F, and the rear arm portion 42 applies pushing force, that is urging force in the downward direction, to the pushing shaft 32B.

Due thereto, the pushing spring 38 applies pushing force in the downward direction to the pushing rollers 30F and 30B that are supported by the pushing shafts 32F and 32B respectively, and pushes the outer peripheral surfaces of these pushing rollers 30F and 30B against the outer peripheral surfaces of the driving rollers 26F and 26B.

In this state, the pushing shafts 32 do not contact rail lower end surfaces 34D that restrict movement of these pushing shafts 32 in the downward direction at the pushing roller rails 34, and are positioned slightly further upward than these rail lower end surfaces 34D.

At the roller conveying section 20, upwardly-directed reaction force, that corresponds to the downwardly-directed pushing force, is applied to the supporting point shaft 36 via the pushing spring 38.

Therefore, due to the supporting point shaft 36 being pushed against the laterally long upper end surfaces 60U of the frame hole portions 56, the supporting point shaft 36 directly contacts the frame 19 and is electrically conductive therewith.

Because the pushing rollers 30 (30F and 30B) are pushed against the driving rollers 26 (26F and 26B), the pushing rollers 30 rotate together in accordance with the rotation of the driving rollers 26.

In this way, at the roller conveying section 20, the pushing rollers 30F and 30R are urged by the pushing spring 38, and the front portion and the rear portion of the bank note that is being conveyed are nipped between the pushing rollers 30F and the driving rollers 26F that are disposed at the front, and by the pushing rollers 30B and the driving rollers 26B that are disposed at the rear, respectively.

Namely, the roller conveying section 20 nips the bank note, that has been conveyed-in from the rear side in FIG. 4 for example, by the pushing rollers 30 and the driving rollers 26 that rotate, and conveys the bank note toward the front side in the drawing, while preventing folding-over and the like by the upper conveying guide 44 and the lower conveying guide 46.

At the roller conveying section 20, the upper conveying guide 44 is structured from a transparent member. Therefore, merely by looking at the roller conveying section 20 from above, a worker may easily confirm the state of the bank note that is being conveyed along the bank note conveying path 48, and, in a case in which a bank note becomes jammed, may quickly find that bank note.

1-4. Assembly of Roller Conveying Section

Figure 9:
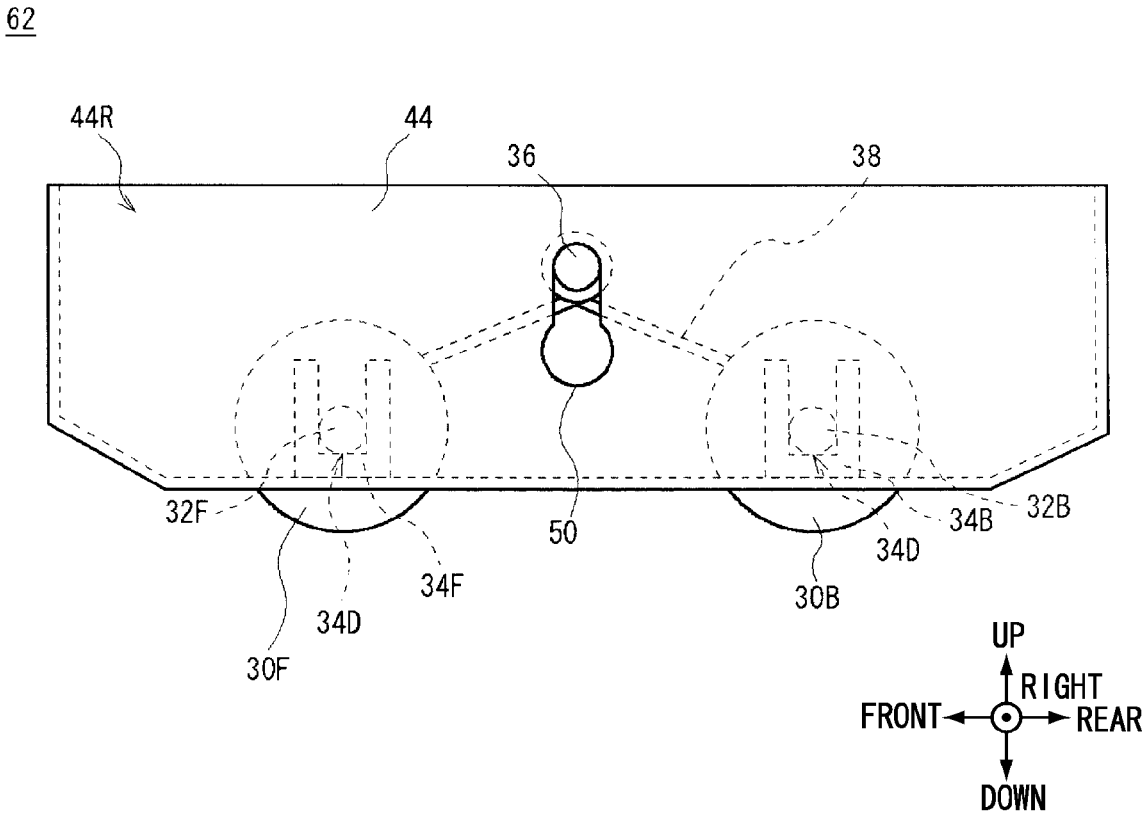
FIG. 9 is a right side view showing structure (1) of an upper conveying unit in accordance with the first exemplary embodiment.
Figure 10:
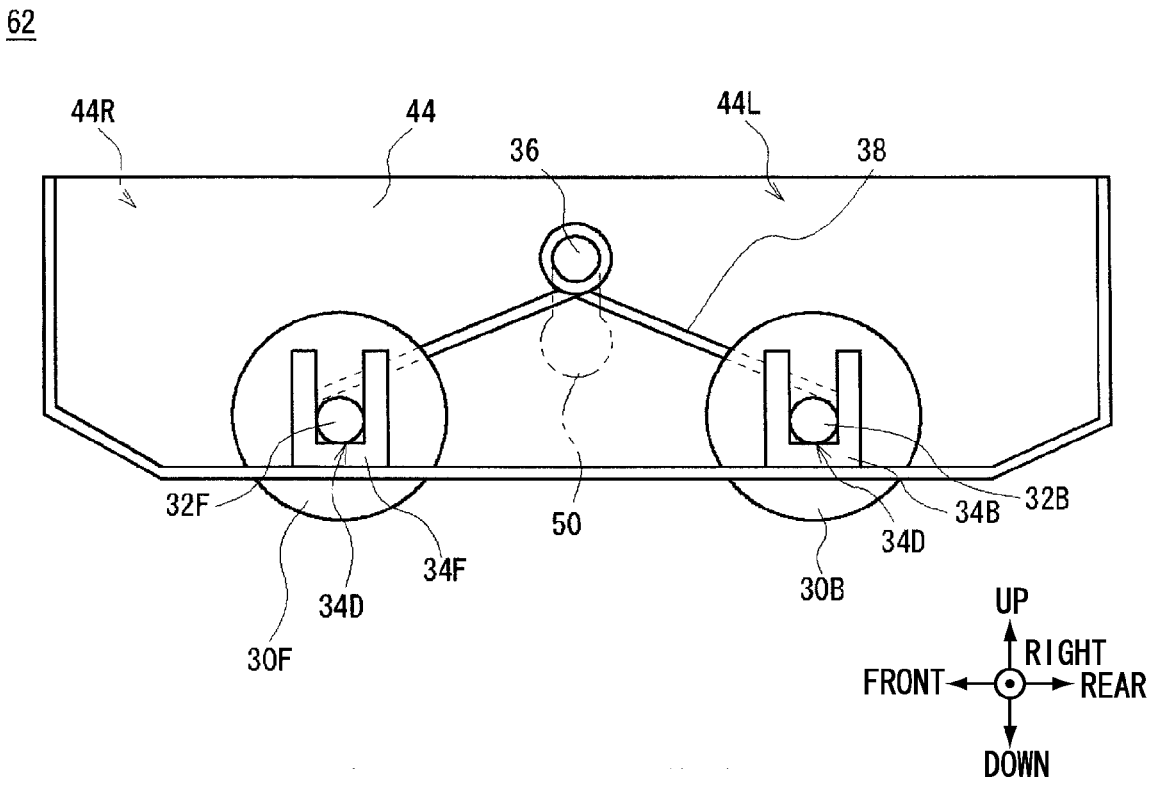
FIG. 10 is a right side view showing structure (2) of the upper conveying unit in accordance with the first exemplary embodiment.

The upper conveying unit 62 in accordance with the first exemplary embodiment of the present invention is shown in FIG. 9 to FIG. 12. FIG. 9 shows the upper conveying unit 62 seen from the right side of the upper guide right side plate 44R, and FIG. 10 shows the upper conveying unit 62 seen from the right side through the upper guide right side plate 44R. In FIG. 10, the upper guide right side plate 44R is shown virtually by the two-dot chain line.

Figure 11:
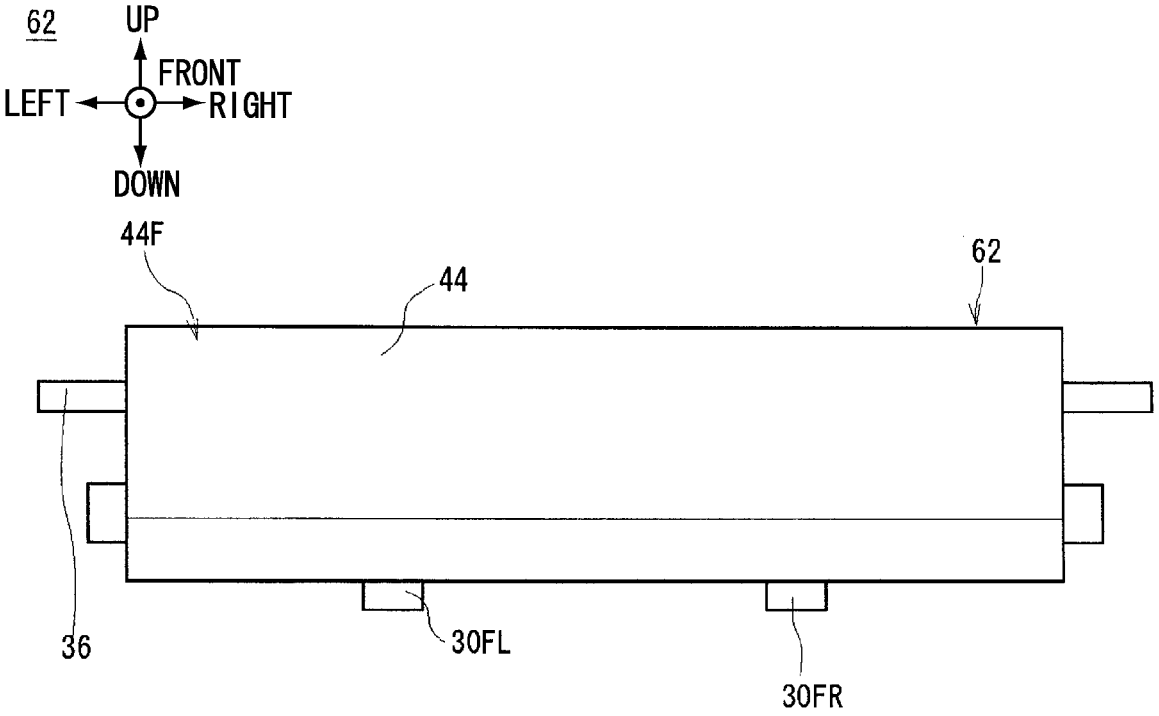
FIG. 11 is a right side view showing structure (3) of the upper conveying unit in accordance with the first exemplary embodiment.
Figure 12:
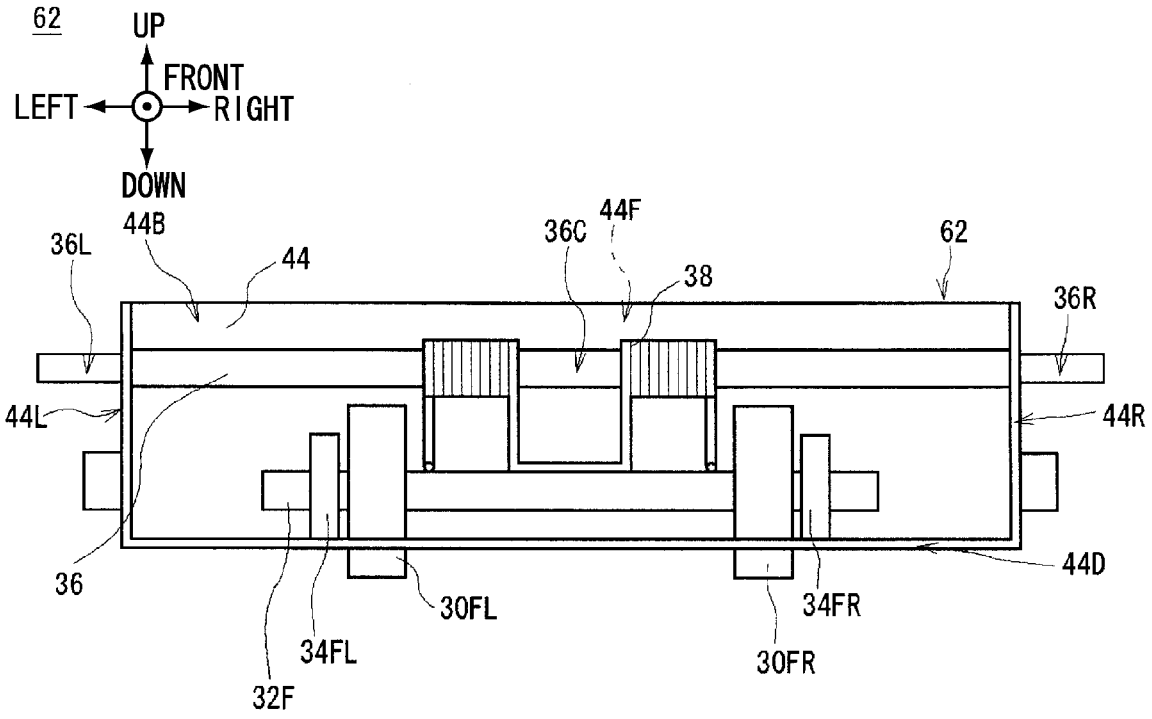
FIG. 12 is a right side view showing structure (4) of the upper conveying unit in accordance with the first exemplary embodiment.
Figure 13:
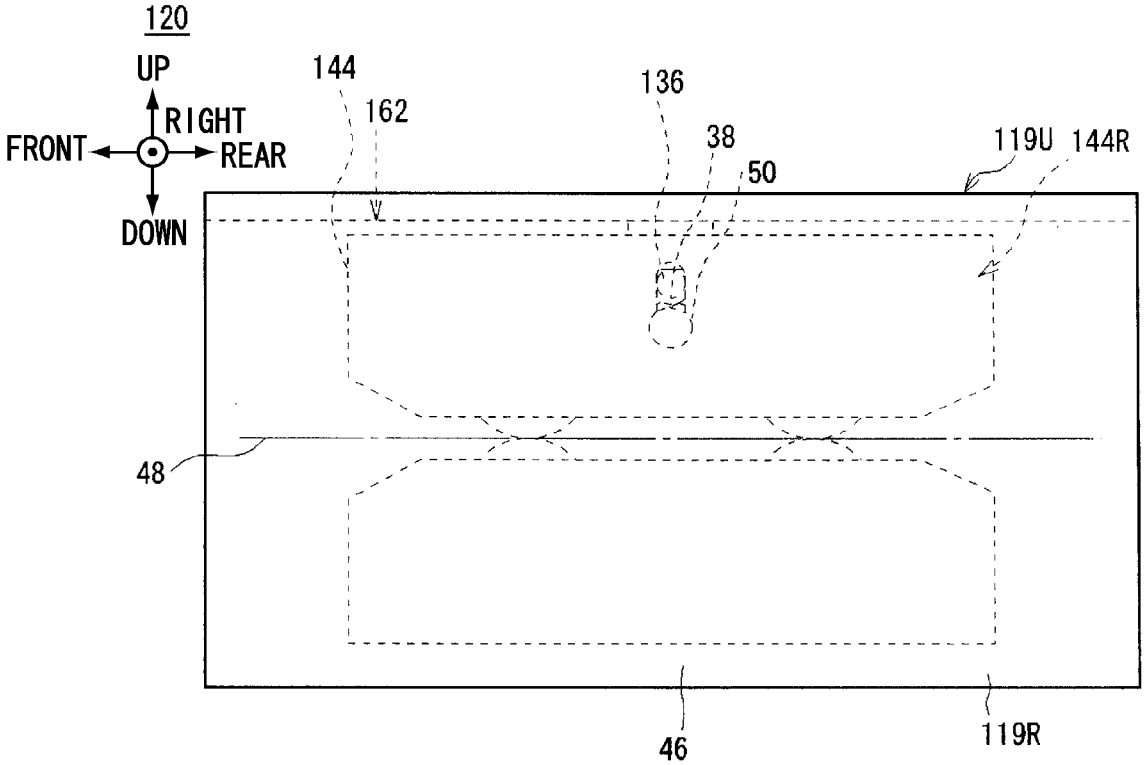
FIG. 13 is a right side view showing structure (1) of a roller conveying section in accordance with a second exemplary embodiment.
Figure 14:
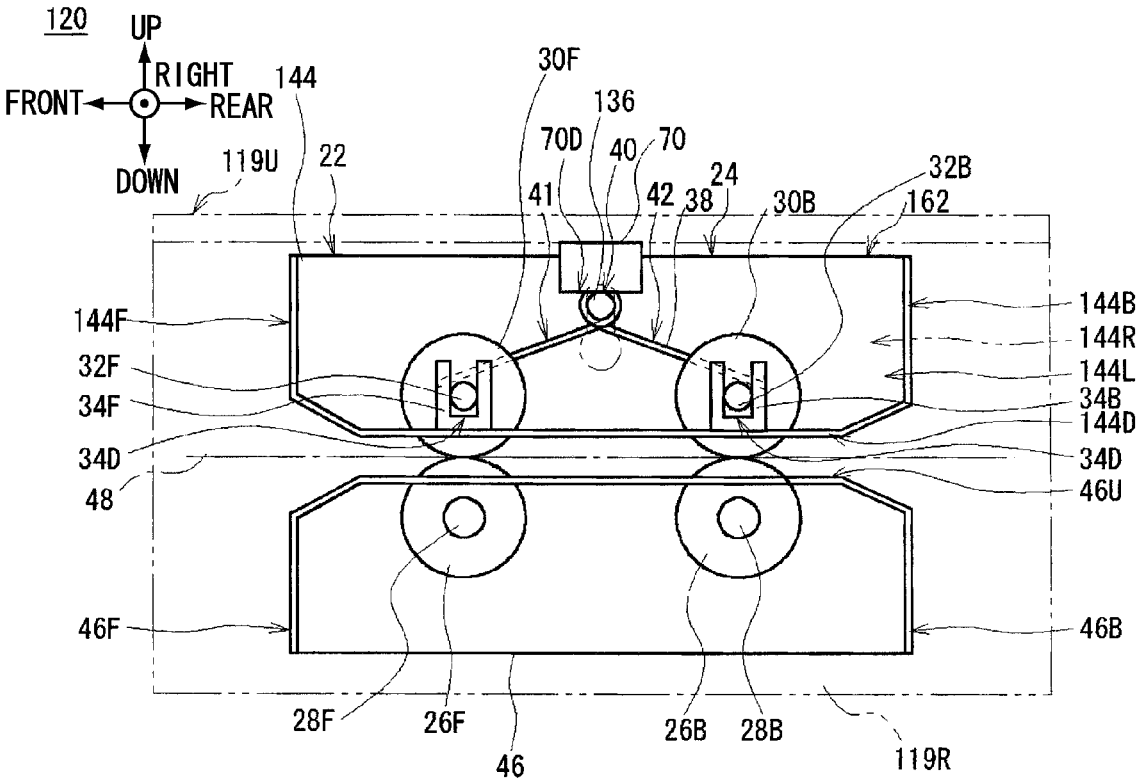
FIG. 14 is a right side view showing structure (2) of the roller conveying section in accordance with the second exemplary embodiment.
Figure 15:
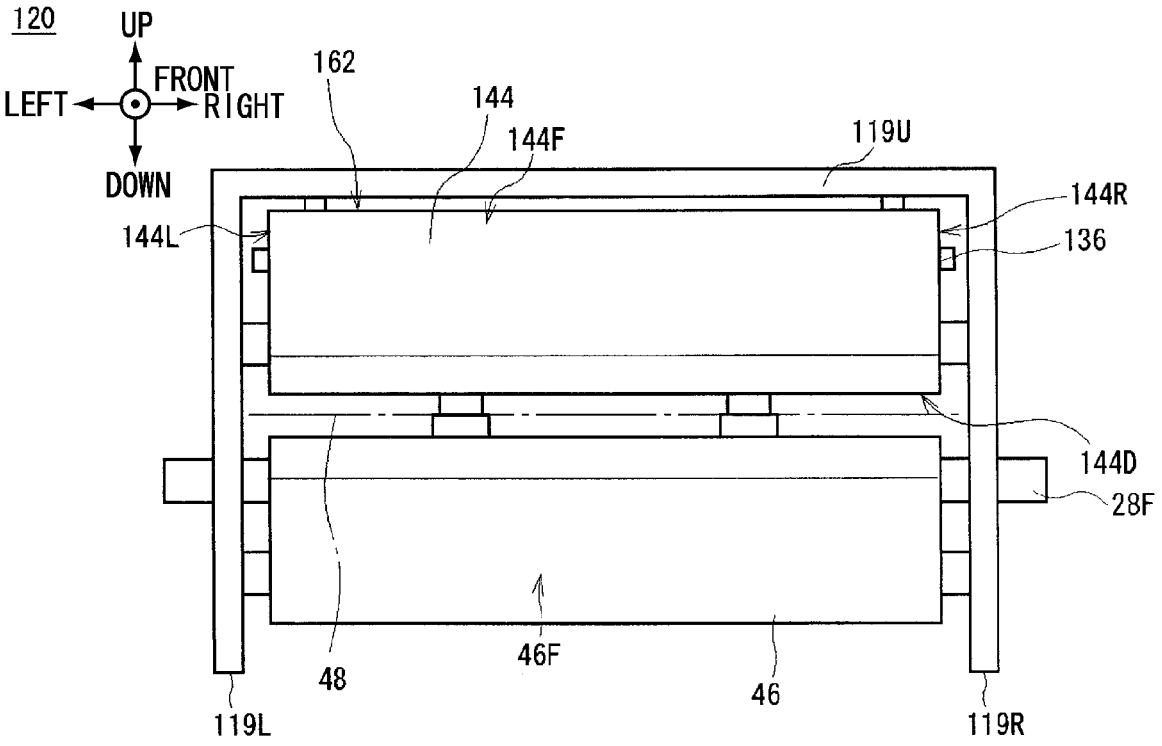
FIG. 15 is a right side view showing structure (3) of the roller conveying section in accordance with the second exemplary embodiment.
Figure 16:
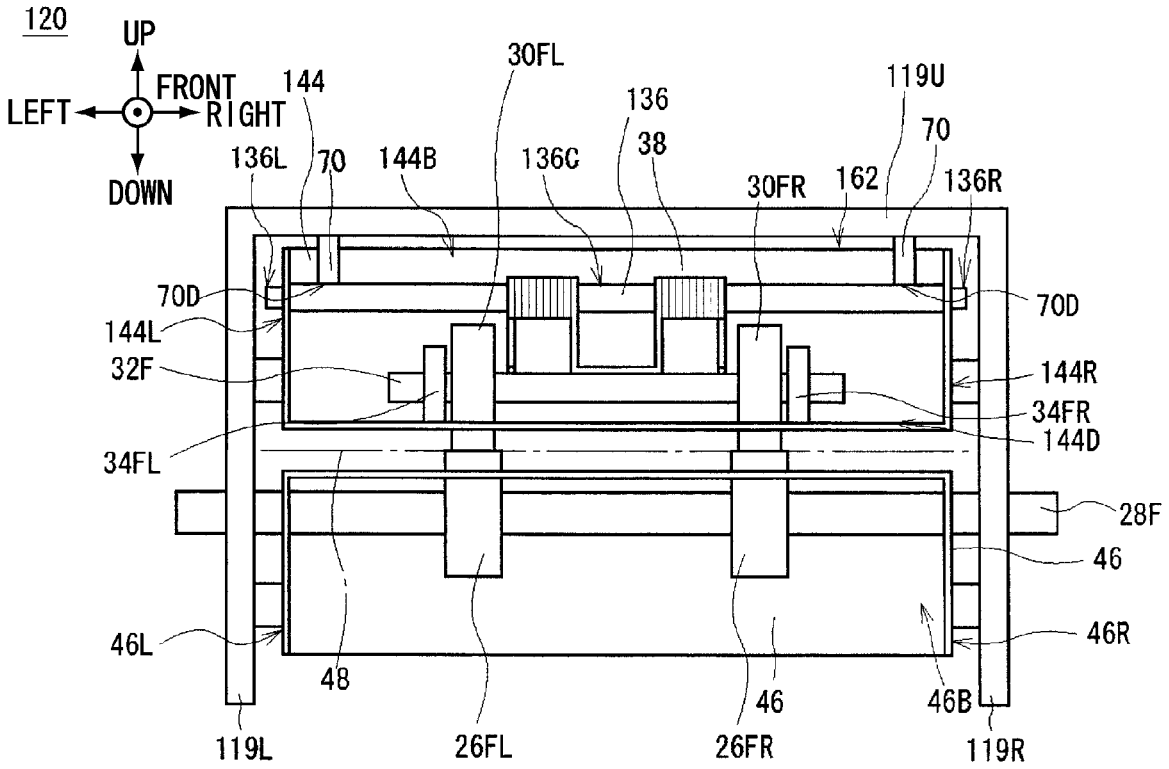
FIG. 16 is a right side view showing structure (4) of the roller conveying section in accordance with the second exemplary embodiment.

FIG. 11 shows the upper conveying unit 62 seen from the front side of the upper guide front side plate 44R. FIG. 12 shows the upper conveying unit 62 seen from the front side through the upper guide front side plate 44F.

At the roller conveying section 20, the upper conveying unit 62 is made into a sub-assembly. At the time when the bank note processing device 1 is manufactured, the roller conveying section 20 is assembled due to the upper conveying unit 62, that has been assembled in advance, being fit into the frame 19.

At the time of assembling this upper conveying unit 62, first, the worker mounts the pushing rollers 30 and the pushing shafts 32 to the upper conveying guide 44 by fitting the left and right end portions of the pushing shafts 32, that have been inserted through the pushing rollers 30, into the pushing roller rails 34 of the upper conveying guide 44.

Next, the worker inserts the supporting point shaft 36 into the insertion hole portion 52 of the guide hole portion 50 from the outer side of either of the upper guide right side plate 44R or the upper guide left side plate 44L, and inserts the supporting point shaft 36 through the wound portion 40 of the pushing spring 38.

Moreover, the worker mounts the supporting point shaft 36 and the pushing spring 38 to the upper conveying guide 44 by fitting the supporting point shaft left end portion 36L and the supporting point shaft right end portion 36R into the guide hole portions 50 while causing the front arm portion 41 and the rear arm portion 42 of the pushing spring 38 to abut the upper sides of the pushing shafts 32F and 32B respectively.

At this time, due to the reaction force from the pushing spring 38, movement of the supporting point shaft 36 is restricted due to the supporting point shaft 36 being pushed such that the upper end portion abuts the fit-in upper end surfaces 54U of the fit-in hole portions 54 at the guide hole portions 50, and due to the front end portion abutting the fit-in front end surfaces 54F and the rear end portion abutting the fit-in rear end surfaces 54B respectively. Due to the above-described processes, the upper conveying unit 62 is assembled into one sub-assembly.

In this state, the supporting point shaft 36 is positioned such that the position thereof in the vertical direction with respect to the upper conveying guide 44 is further upward than in the state in which the roller conveying section 20 has been assembled. Further, due to the pushing force from the pushing spring 38, the pushing rollers 30 are pushed against the rail lower end surfaces 34D of the pushing roller rails 34.

Therefore, although the reaction force from the pushing spring 38 is slightly weaker than in the state in which the roller conveying section 20 has been assembled, the supporting point shaft 36 is urged by the reaction force from the pushing spring 38, and does not come-out from the upper conveying guide 44. Due thereto, the upper conveying unit 62 can be made into a sub-assembly.

Next, the worker assembles the roller conveying section 20. First, the worker inserts the left and right end portions of the driving roller shafts 28, that have been inserted through the driving rollers 26, into hole portions that are not illustrated and that are formed in the frame 19.

Next, the worker fixes the lower conveying guide 46 to the frame 19 by fitting the lower conveying guide 46 into hole portions, that are formed in the frame 19 and are not illustrated, from above.

Next, the worker mounts the upper conveying unit 62, that has been made into a sub-assembly, to the frame 19. Concretely, the worker inserts the supporting point shaft 36, that projects-out to the exterior from the upper guide right side plate 44R and the upper guide left side plate 44L, in the downward direction along the arrow in FIG. 8 from the vertically long hole portions 58 of the frame hole portions 56, and thereafter, moves the supporting point shaft 36 in the rearward direction along the laterally long hole portions 60.

At this time, the upper conveying unit 62 is positioned at the frame 19 due to predetermined projections of the upper conveying guide 44 being fit into predetermined hole portions that are provided together with the frame hole portions 56 in the frame 19. Due to the above-described processes, the roller conveying section 20 is assembled.

At the roller conveying section 20, the laterally long upper end surfaces 60U of the frame hole portions 56 are positioned slightly further downward than the fit-in upper end surfaces 54U of the guide hole portions 50.

Therefore, due to the reaction force from the pushing spring 38, the supporting point shaft 36 is pushed such that the upper end portion thereof abuts the laterally long upper end surfaces 60U of the laterally long hole portions 60.

Further, more so than in the state in which the upper conveying unit 62 is a unit by itself that has not been assembled into the frame 19, the pushing spring 38 is compressed and a greater reaction force is applied to the supporting point shaft 36. Due thereto, the supporting point shaft 36 is urged in the upward direction more strongly than in the state in which the upper conveying guide 44 is a unit by itself, and contacts the frame 19.

Further, movement of the supporting point shaft 36 is restricted due to the left end portion abutting the fit-in front end surfaces 54F of the fit-in hole portions 54 at the guide hole portions 50, and the rear end portion abutting the fit-in rear end surfaces 54B, respectively.

In this way, at the roller conveying section 20, due to reaction force being applied from the pushing spring 38 to the supporting point shaft 36 and the supporting point shaft 36 being inserted in the frame hole portions 56, the supporting point shaft 36 is made to contact the frame 19 directly, and may be made to be electrically conductive.

Due thereto, at the roller conveying section 20, the pushing spring 38 is made to contact the pushing shafts 32 that are made of metal, and the supporting point shaft 36 is made to contact the pushing spring 38, and moreover, the supporting point shaft 36 is made to contact the frame 19. Due thereto, these pushing shafts 32, pushing spring 38, and supporting point shaft 36 that are made of metal can be made to be electrically conductive with the frame 19.

1-5. Operation and Effects

In the above-described structure, at the roller conveying section 20, due to the supporting point shaft 36 being fit into the fit-in hole portions 54 of the guide hole portions 50, positioning of the supporting point shaft 36 in the front-rear direction with respect to the upper conveying guide 44 is carried out, and the supporting point shaft 36 is pushed against the fit-in upper end surfaces 54U of the guide hole portions 50 by using the reaction force of the pushing spring 38. Due thereto, positioning, in the upward direction, of the supporting point shaft 36 with respect to the upper conveying guide 44 is carried out.

Due thereto, the mechanism parts at the interior of the upper conveying guide 44 are fixed to the upper conveying guide 44, and the upper conveying unit 62 can be structured as one sub-assembly. Therefore, at the time of assembling the roller conveying section 20, the roller conveying section 20 may be assembled merely by assembling the upper conveying unit 62, that has already been assembled, to the frame 19, and assembly may be made easy.

Here, at the time of assembling the upper conveying unit 62, if the supporting point shaft 36 were to not contact the upper conveying guide 44 at a predetermined position while being pushed in a predetermined direction, the upper conveying unit 62 could not be made into a sub-assembly because the structural members at the interior of the upper conveying guide 44 could not be fixed to the upper conveying guide 44.

In contrast, in the upper conveying guide 62, due to the supporting point shaft 36 being pushed against the upper conveying guide 44 along the direction of the reaction force of the pushing spring 38 by using this reaction force, the position of the supporting point shaft 36 in the vertical direction is positioned with respect to and fixed to the upper conveying guide 44, and, by fitting the supporting point shaft 36 into the fit-in hole portions 54, the position of the supporting point shaft 36 in the front-rear direction is positioned. Therefore, the upper conveying unit 62 may be made into a sub-assembly.

Further, at the roller conveying section 20, the upper conveying unit 62 is mounted to the frame 19, and the supporting point shaft 36 is pushed-against the laterally long upper end surfaces 60U of the frame hole portions 56 by using the reaction force of the pushing spring 38. Due thereto, the supporting point shaft 36 may be made to directly contact the frame 19, and may be made to be electrically conductive with respect to the frame 19.

Due thereto, at the roller conveying section 20, the upper conveying unit 62 is made into a sub-assembly, and the efficiency of assembling the roller conveying section 20 improves, and the supporting point shaft 36 is made to contact the frame 19. Due thereto, the pushing rollers 30, the pushing shafts 32 and the pushing spring 38 that are metal parts are made to be conductive with the frame 19, and the generation of static electricity at the mechanism parts at the interior of the upper conveying guide 44 may be prevented by a simple structure.

Further, at the roller conveying section 20, the outer side metal plate 16 and the inner side metal plate 17 can be omitted as compared with the conventional roller conveying section 220. Therefore, the number of conductive parts that must be connected as a countermeasure to static electricity may be reduced, and the weight of and the cost of the roller conveying section 20 may be reduced.

Further, at the roller conveying section 20, the interior can be viewed from the exterior by forming the upper conveying guide 44 to be transparent by resin molding. However, in this case, because the upper conveying guide 44 is an insulator, the mechanism parts at the interior of the upper conveying guide 44 cannot be made to be conductive with the frame 19 via the upper conveying guide 44.

Therefore, there was the possibility that the structure for making the mechanism parts at the interior of the upper conveying guide 44 be conductive with the frame 19 would become complex.

In contrast, at the roller conveying section 20, by causing the supporting point shaft 36 to contact the frame 19 by utilizing the reaction force of the pushing spring 38, the mechanism parts at the interior of the upper conveying guide 44 can be made to be conductive with the frame 19 by a simple structure.

Further, if the upper conveying guide were to be made to be conductive due to the mixing-in of a conductive material at the time of resin molding, the parts at the interior of the upper conveying guide could be made to be conductive with the frame via the upper conveying guide.

However, in this case, the upper conveying guide would no longer be transparent, and the visibility of the bank note conveying path 48 would deteriorate. In contrast, at the roller conveying section 20, the mechanism parts at the interior of the upper conveying guide 44 can be made to be conductive with the frame 19 while the visibility of the bank note conveying path 48 is maintained.

In accordance with the above-described structure, the roller conveying section 20 that serves as a media conveying device in the bank note processing device 1 has: the upper conveying guide 44 that is electrically non-conductive, and that forms one side surface of the bank note conveying path 48 at which bank notes are conveyed along a surface direction, and that has an internal space; the frame 19 that is electrically conductive and holds the upper conveying guide 44; the pushing rollers 30 that are provided in the internal space of the upper conveying guide 44, and that convey bank notes by nipping the bank notes between the pushing rollers 30 and the driving rollers 26, that face the pushing rollers 30 with the bank note conveying path 48 therebetween, and rotating; the pushing spring 38 that applies pushing force that urges the pushing rollers 30 toward the driving rollers 26; and the supporting point shaft 36 that is electrically conductive, and whose position in a direction, that is substantially orthogonal to the length direction of the supporting point shaft 36 and the pushing force direction, is positioned by the upper conveying guide 44 at the supporting shaft left end portion 36L and the supporting shaft right end portion 36R that are vicinities of both end portions in the length direction, and that supports the pushing spring 38 at the supporting point shaft central portion 36C that is a vicinity of the central portion in the length direction, and that abuts the laterally long upper end surfaces 60U, that serve as supporting point shaft abutment portions, of the frame 19 by receiving reaction force that arises in a direction of separating from the bank note conveying path 48 in accordance with the pushing force.

Due thereto, at the roller conveying section 20, although the upper conveying unit 62 is made into a sub-assembly, the parts at the interior of the upper conveying unit 62 may be made to be conductive with the frame 19 that is at the exterior.

2. Second Exemplary Embodiment

2-1. Structure of Roller Conveying Section

As shown in FIG. 13 to FIG. 16 in which the same reference numerals are given to parts corresponding to FIG. 3 to FIG. 6, the bank note processing device 1 in accordance with the second exemplary embodiment is structured similarly to the bank note processing device 1 in accordance with the first exemplary embodiment, although a roller conveying section 120 differs from the roller conveying section 20.

Further, at the roller conveying section 120 in accordance with the second exemplary embodiment, a frame 119 differs from the frame 19 in accordance with the first exemplary embodiment.

At the frame 119, in addition to a frame left side plate 119L and a frame right side plate 119R that extend along the vertical direction at the outer sides in the left-right direction of an upper conveying guide 144 and the lower conveying guide 46, there is provided a frame ceiling plate 119U that connects the upper end portions of the frame left side plate 119L and the frame right side plate 119R along the horizontal direction and that covers the upper conveying guide 144 from the upper side.

Further, position restricting portions 70, that are parallelepiped and project-out in the downward direction, are formed at places of the bottom surface of the frame ceiling plate 119U, which places face a supporting point shaft 136. The position restricting portions 70 abut vicinities of the end portions in the left-right direction of a supporting point shaft central portion 136C at the supporting point shaft 136.

Further, due to the supporting point shaft 136 being formed such that the length thereof in the left-right direction is shorter than that of the supporting point shaft 36 (FIG. 6), a supporting point shaft left end portion 136L and a supporting point shaft right end portion 136R at the supporting point shaft 136 fit into the guide hole portions 50 that are formed in the upper conveying guide 144, but do not contact the frame 119. Further, differently than the frame 19, the frame hole portions 56 are not formed in the frame 119.

2-2. Assembly of Roller Conveying Section

At this roller conveying section 120, an upper conveying unit 162 is made into a sub-assembly in the same way as the upper conveying unit 62. At the time when the bank note processing device 1 is manufactured, the roller conveying section 120 is assembled due to the upper conveying unit 162, that has been assembled in advance, being fit into the frame 119.

At the time of assembling this upper conveying unit 162, the worker carries out processes that are similar to those of the above-described upper conveying unit 62, and assembles the upper conveying unit 162 as one sub-assembly.

In the state in which the upper conveying unit 162 is a unit by itself, the position of the supporting point shaft 136 in the vertical direction with respect to the upper conveying guide 44 is positioned further toward the upper side than in the state in which the roller conveying section 120 has been assembled. Further, due to the pushing force from the pushing spring 38, the pushing rollers 30 are pushed against the rail lower end surfaces 34D of the pushing roller rails 34.

Therefore, although the reaction force from the pushing spring 38 is slightly weaker than in the state in which the roller conveying section 120 has been assembled, the supporting point shaft 36 is urged by the reaction force from the pushing spring 38, and does not come-out from the upper conveying guide 144. Due thereto, the upper conveying unit 162 can be made into a sub-assembly.

Next, the worker assembles the roller conveying section 120. First, the worker carries out processes that are similar to those of the above-described roller conveying section 20, and assembles the driving rollers 26, the driving roller shafts 28 and the lower conveying guide 46 to the frame 119.

Next, the worker mounts the upper conveying unit 162, that has been made into a sub-assembly, to the frame 119. Concretely, the worker positions the supporting point shaft 136 beneath position restricting bottom end surfaces 70D that are the bottom end surfaces of the position restricting portions 70, and fits predetermined projections of the upper conveying guide 144 into predetermined hole portions that are provided in the frame 19. Due thereto, the upper conveying unit 162 is positioned at the frame 119. Due to the above-described processes, the roller conveying section 20 is assembled.

Figure 17:
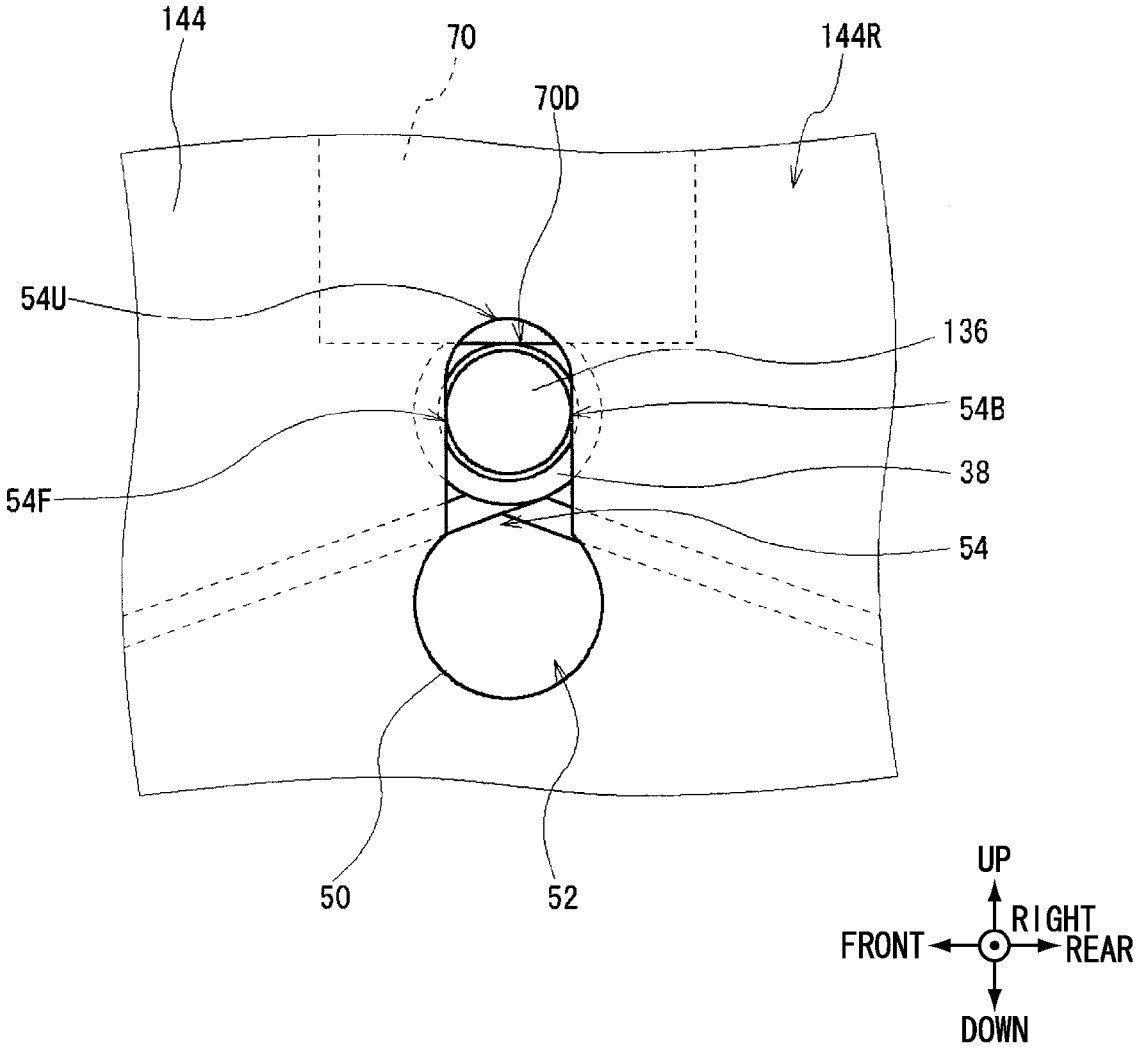
FIG. 17 is a right side view showing the structures of a supporting point shaft, the guide hole portion and a position restricting portion in accordance with the second exemplary embodiment.
Figure 18:
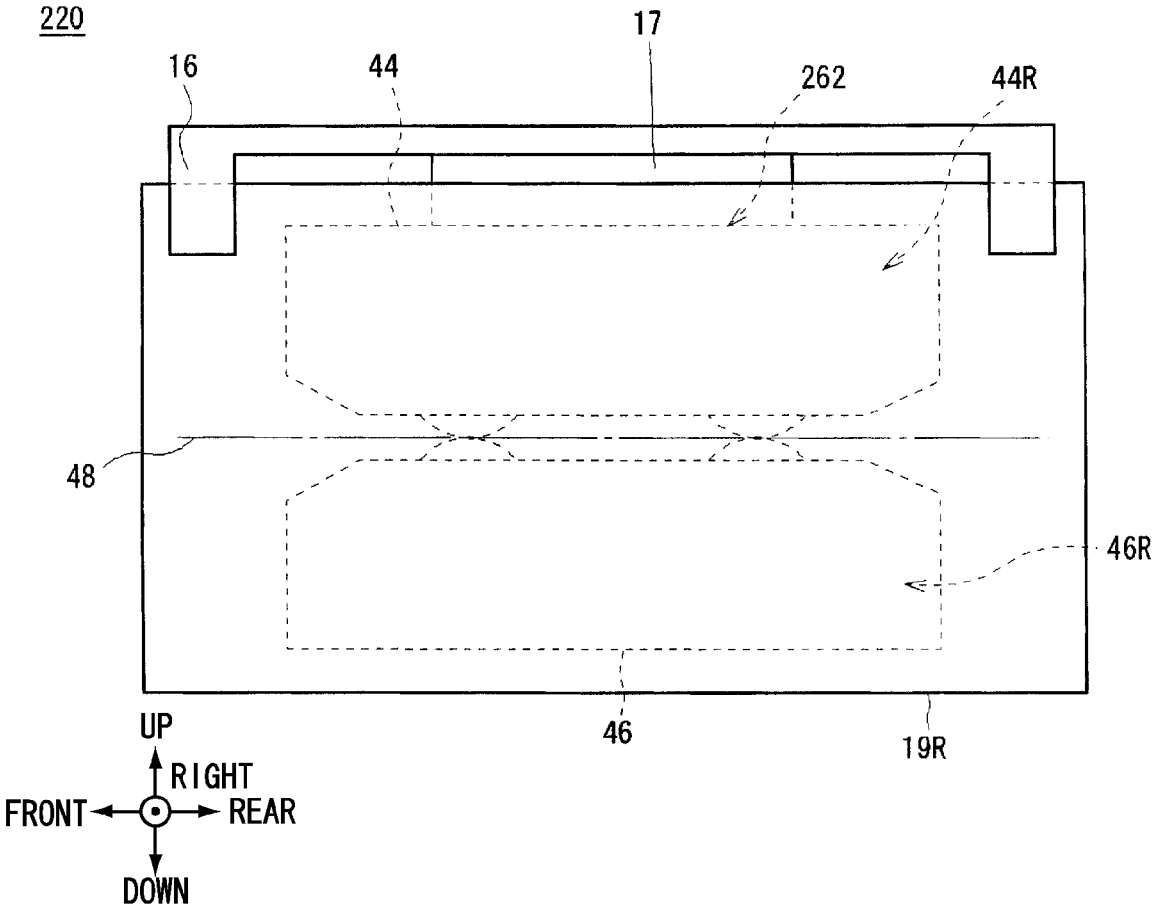
FIG.18 RELATED ART
FIG. 18 is a right side view showing structure (1) of a conventional roller conveying section.
Figure 19:
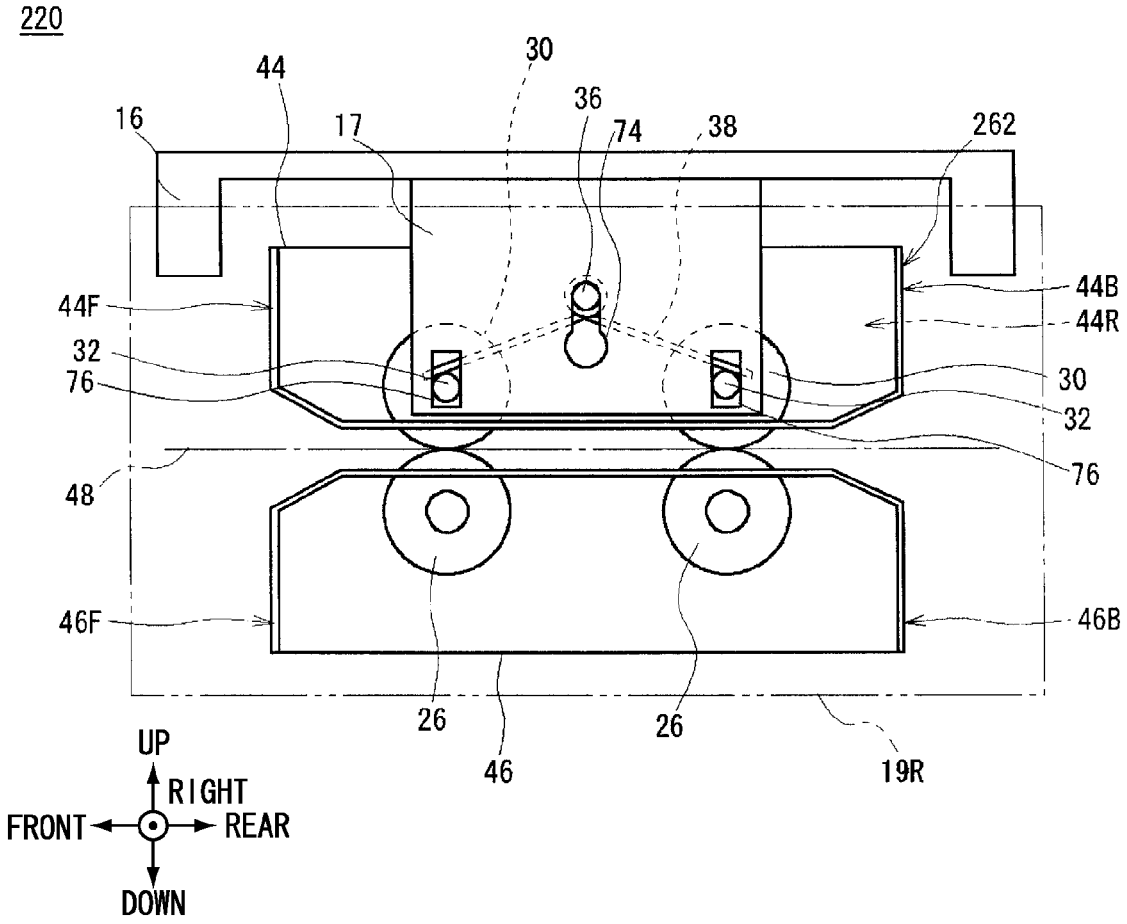
FIG.19 RELATED ART
FIG. 19 is a right side view showing structure (2) of the conventional roller conveying section.
Figure 20:
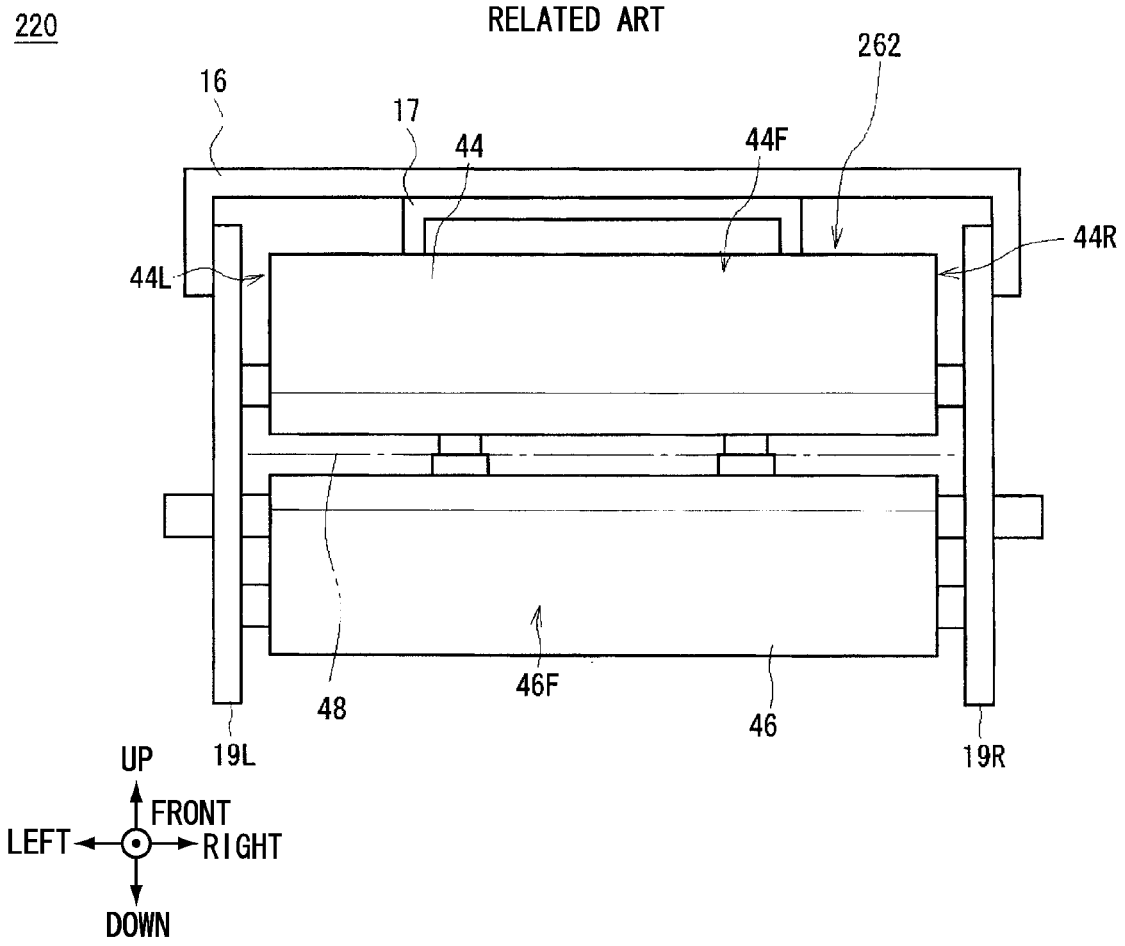
FIG.20 RELATED ART
FIG. 20 is a right side view showing structure (3) of the conventional roller conveying section.
Figure 21:
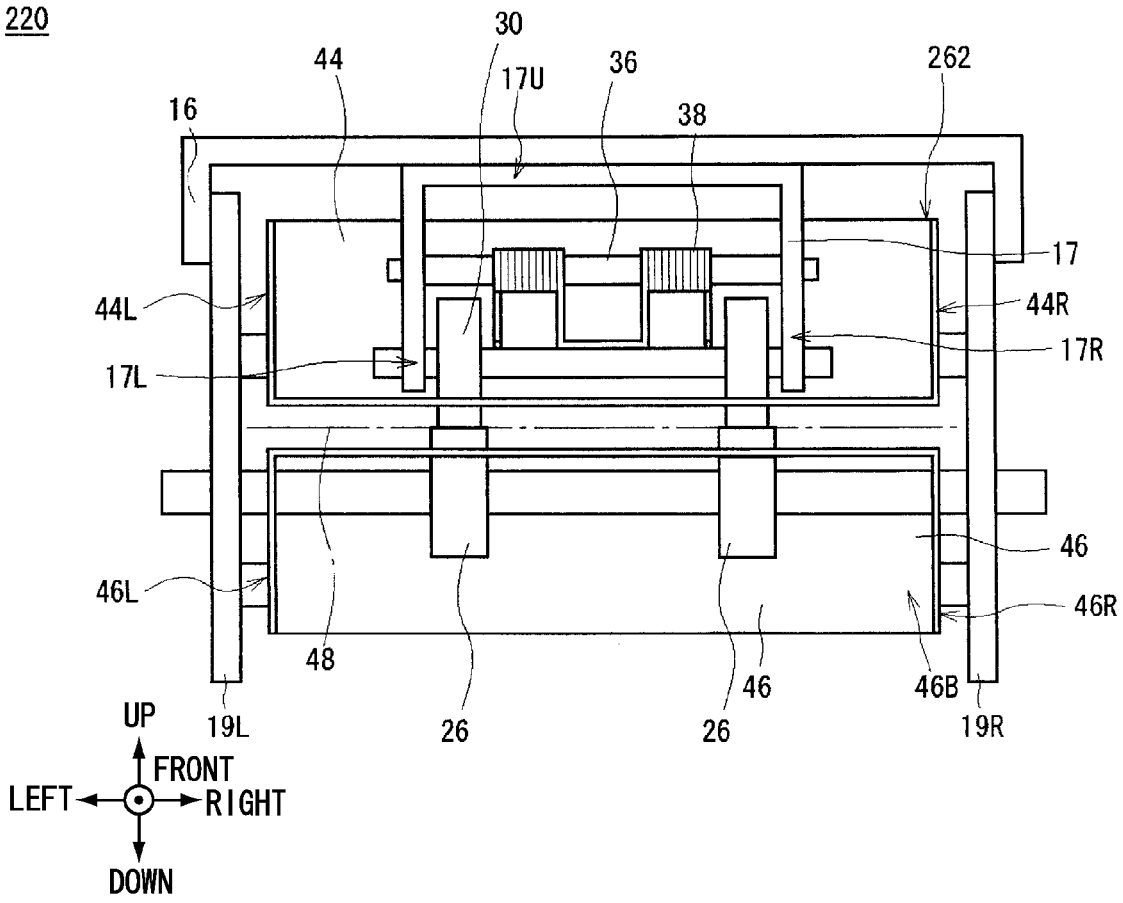
FIG.21 RELATED ART
FIG. 21 is a right side view showing structure (4) of the conventional roller conveying section.

As shown in FIG. 17, at the roller conveying section 120, the position restricting bottom end surfaces 70D are positioned slightly further toward the lower side than the fit-in upper end surfaces 54U of the guide hole portions 50.

Therefore, due to the reaction force from the pushing spring 38, the supporting point shaft 136 is pushed such that the upper end portion thereof abuts the position restricting bottom end surfaces 70D of the position restricting portions 70.

Further, more so than in the state in which the upper conveying unit 162 is a unit by itself that has not been assembled into the frame 119, the pushing spring 38 is compressed and a greater reaction force is applied to the supporting point shaft 136. Due thereto, the supporting point shaft 136 is urged in the upward direction more strongly than in the state in which the upper conveying guide 144 is a unit by itself, and contacts the frame 119.

Further, movement of the supporting point shaft 136 is restricted due to the left end portion abutting the fit-in front end surfaces 54F of the fit-in hole portions 54 at the guide hole portions 50, and the rear end portion abutting the fit-in rear end surfaces 54B, respectively.

In this way, at the roller conveying section 120, due to reaction force being applied from the pushing spring 38 to the supporting point shaft 136 and the supporting point shaft 136 being made to abut beneath the position restricting bottom end surfaces 70D, the supporting point shaft 136 is made to contact the frame 119 directly, and may be made to be electrically conductive.

Due thereto, at the roller conveying section 120, the pushing spring 38 is made to contact the pushing shafts 32 that are made of metal, and the supporting point shaft 136 is made to contact the pushing spring 38, and moreover, the supporting point shaft 136 is made to contact the frame 119. Due thereto, these pushing shafts 32, pushing spring 38, and supporting point shaft 136 that are made of metal may be made to be electrically conductive with the frame 119.

In this way, at the roller conveying section 20 (FIG. 4), the supporting point shaft 36 is made to contact the frame 19 due to the supporting point shaft 36 being inserted into the frame hole portions 56. However, at the roller conveying section 120, the supporting point shaft 136 is pushed upward from beneath against the position restricting portions 70 of the frame 119.

Due thereto, at the roller conveying section 120, the upper conveying unit 162 is made into a sub-assembly, and the efficiency of assembling the roller conveying section 120 improves, and the supporting point shaft 136 is made to contact the frame 119. Due thereto, the pushing rollers 30, the pushing shafts 32 and the pushing spring 38 that are metal parts are made to be conductive with the frame 119, and the generation of static electricity at the mechanism parts at the interior of the upper conveying guide 144 may be prevented by a simple structure.

In accordance with the above-described structure, the roller conveying section 120 that serves as a media conveying device at the bank note processing device 1 has: the upper conveying guide 144 that is electrically non-conductive, and that forms one side surface of the bank note conveying path 48 at which bank notes are conveyed along a surface direction, and that has an internal space; the frame 119 that is electrically conductive and holds the upper conveying guide 144; the pushing rollers 30 that are provided in the internal space of the upper conveying guide 144, and that convey the bank notes by nipping the bank notes between the pushing rollers 30 and the driving rollers 26, that face the pushing rollers 30 with the bank note conveying path 48 therebetween, and rotating; the pushing spring 38 that applies pushing force that urges the pushing rollers 30 toward the driving rollers 26; and the supporting point shaft 136 that is electrically conductive, and whose position in a direction, that is substantially orthogonal to a length direction of the supporting point shaft 136 and the pushing force direction, is positioned by the upper conveying guide 144 at a supporting point shaft left end portion 136L and a supporting point shaft right end portion 136R that are vicinities of both end portions in the length direction, and that supports the pushing spring 38 at the supporting point shaft central portion 136C that is a vicinity of the central portion in the length direction, and that abuts position restricting bottom end surfaces 70D, that serve as supporting point shaft abutment portions, of the frame 119 by receiving reaction force that arises in a direction of separating from the bank note conveying path 48 in accordance with the pushing force.

Due thereto, at the roller conveying section 120, although the upper conveying unit 162 is made into a sub-assembly, the parts at the interior of the upper conveying unit 162 may be made to be conductive with the frame 119 that is at the exterior.

3. Other Exemplary Embodiments

Note that the above-described exemplary embodiments describe cases in which the upper conveying guide 44 is formed to be transparent. The present invention is not limited to this, and, for example, the upper conveying guide may be formed to be semi-transparent, and, in short, it suffices for the upper conveying guide to be formed such that the interior can be viewed through from the exterior.

Further, the above-described embodiments described above describe cases in which the upper conveying guide 44 is formed to be transparent, and the lower conveying guide 46 is formed from a metal plate that is non-transparent and is high-strength. The present invention is not limited to this, and the lower conveying guide 46 may be formed to be transparent.

Moreover, the above-described exemplary embodiments describe cases in which the roller conveying section 20 is structured from the two sets of conveying sections at the front and the rear that are the front side conveying section 22 and the rear side conveying section 24.

The present invention is not limited to this, and the roller conveying section 20 may be structured by only either one conveying section among the front side conveying section 22 and the rear side conveying section 24.

Moreover, the above-described exemplary embodiments describe cases in which the pushing rollers 30 are urged by the pushing spring 38 that is a torsion spring. The present invention is not limited to this, and the pushing rollers 30 may be urged by using any of various mechanisms, such as, for example, a plate spring or the like.

Moreover, the above-described exemplary embodiments describe cases in which the guide hole portions 50 are substantially gourd shaped. The present invention is not limited to this, and the guide hole portions 50 may be any of various shapes through which the supporting point shaft 36 can be inserted and that can make the supporting point shaft 36 abut the fit-in upper end surfaces 54U.

Moreover, the above-described exemplary embodiments describe cases in which the supporting point shaft 36 is made to contact the frame 19 along the direction of the reaction force in the upward direction generated by the pushing spring 38 in accordance with the pushing force that arises in the downward direction.

The present invention is not limited to this. Pushing force, that is from the downward direction and that runs along a direction that is inclined with respect to the front-rear or the left-right direction, may be applied from the pushing spring 38 to the pushing shafts 32, and the supporting point shaft 36 may be made to contact the frame 19 along reaction force from the upward direction that is generated in accordance with this pushing force and that is inclined with respect to the front-rear or the left-right direction.

Further, the direction of the reaction force, that runs along the direction of the reaction force in the upward direction, may be converted by a predetermined member, and the supporting point shaft 36 may be made to contact the frame 19 from the upward direction at an incline with respect to the front-rear or left-right direction.

In short, it suffices for the pushing rollers 30, the pushing shafts 32, the pushing spring 38 and the supporting point shaft 36 to be made to be conductive with the frame 19 due to the supporting point shaft 36 being urged by reaction force, that is generated by the pushing spring 38 in accordance with the pushing force that pushes the pushing rollers 30, and the supporting point shaft 36 being made to contact the frame 19 that holds the upper conveying guide 44.

Moreover, although the above-described exemplary embodiments describe cases in which the pushing rollers 30 are structured of metal, the present invention is not limited to this, and the pushing rollers may be structured of rubber or the like.

Moreover, the above-described exemplary embodiments describe cases in which the pushing rollers 30, the pushing shafts 32, the pushing spring 38 and the supporting point shaft 36 are structured of metal. The present invention is not limited to this, and these parts may be structured by, for example, insulators whose surfaces are plated with conductive materials. In short, it suffices for there to be electrical conductivity due to surfaces contacting one another.

Moreover, the above-described exemplary embodiments describe cases in which the present invention is applied at times of conveying bank notes at the roller conveying section 20 of the bank note processing device 1 that processes cash.

The present invention is not limited to this, and may be applied at times when media are conveyed in, for example, an automated teller machine at which media such as cash or the like are inserted and that carries out a desired transaction.

Moreover, although the above-described exemplary embodiments describe bank notes that serve as the media, the present invention is not limited to this, and it suffices for there to be thin, paper-sheet-like media such as, for example, gift certificates, cash vouchers, admission tickets, or the like.

Moreover, the above-described exemplary embodiments describe cases in which the roller conveying section 20 that serves as the media conveying device is structured by the upper conveying guide 44 that serves as the conveying guide, the frame 19 that serves as the frame, the pushing rollers 30 that serve as the pushing rollers, the pushing spring 38 that serves as the pushing roller urging portion, and the supporting point shaft 36 that serves as the supporting point shaft.

The present invention is not limited to this, and the media conveying device may be structured by a conveying guide, a frame, pushing rollers, a pushing roller urging portion and a supporting point shaft of any of various other structures.

Moreover, the above-described exemplary embodiments describe cases in which the bank note processing device that serves as the media processing device is structured by the operation section 6 that serves as the operation section, the bank note conveying path 48 that serves as the conveying path, the upper conveying guide 44 that serves as the conveying guide, the frame 19 that serves as the frame, the pushing rollers 30 that serve as the pushing rollers, the pushing spring 38 that serves as the pushing roller urging portion, and the supporting point shaft 36 that serves as the supporting point shaft.

The present invention is not limited to this, and the media processing device may be structured by an operation section, a conveying path, a conveying guide, a frame, pushing rollers, a pushing roller urging portion and a supporting point shaft of any of various other structures.

The disclosure of Japanese Patent Application No. 2012-274939 is, in its entirety, incorporated by reference into the present specification.

All publications, patent applications, and technical standards mentioned in the present specification are incorporated by reference into the present specification to the same extent as if such individual publication, patent application, or technical standard was specifically and individually indicated to be incorporated by reference.

INDUSTRIAL APPLICABILITY

The present invention may be applied also to various types of devices that conveying paper-sheet-like media such as bank notes or the like.

The invention claimed is:

1. A media conveying device comprising:

a conveying guide that is electrically non-conductive, that forms one side surface of a conveying path at which media are conveyed along a surface direction, and that has an internal space;

a frame that is electrically conductive and holds the conveying guide;

driving rollers;

pushing rollers provided in the internal space of the conveying guide, the pushing rollers conveying the media, by nipping the media between the pushing rollers and the driving rollers, which face the pushing rollers with the conveying path therebetween, and by rotating;

a pushing roller urging portion that applies a pushing force that urges the pushing rollers toward the driving rollers; and a supporting point shaft that is electrically conductive, and whose position in a first direction, that is substantially orthogonal to a length direction of the supporting point shaft and a direction of the pushing force, is positioned by the conveying guide in vicinities of both end portions of the supporting point shaft in the length direction, the supporting point shaft supports the pushing roller urging portion in a vicinity of a central portion of the supporting point shaft in the length direction, and that abuts supporting point shaft abutment portions of the frame by receiving a reaction force that arises in a direction of separating from the conveying path in accordance with the pushing force.

2. The media conveying device of claim 1, wherein:

the conveying guide, the pushing rollers, the pushing roller urging portion, and the supporting point shaft are connected together to form an integral unit and form a conveying unit that is mounted to the frame, and the supporting point shaft is fixed to the conveying guide due to the vicinities of the both end portions in the length direction being inserted through guide hole portions that are formed in the conveying guide, and due to distal end side end portions of the supporting point shaft in the first direction and a direction opposite the first direction contacting the guide hole portions due to a distal end side end component of the reaction force.

3. The media conveying device of claim 2, wherein, at the pushing roller urging portion, at a time when the conveying unit is mounted to the frame, the pushing force and the reaction force are stronger than in a state in which the conveying unit is a separate unit.

4. The media conveying device of claim 3, wherein the pushing roller urging portion is a spring, and, at the time when the conveying unit is mounted to the frame, the pushing roller urging portion is compressed more than in the state in which the conveying unit is a separate unit.

5. The media conveying device of claim 4, wherein the supporting point shaft abutment portions are positioned further toward distal end components of the pushing force than distal end side end surfaces which are the distal end side end surfaces, in a direction of the reaction force, of the guide hole portions of the conveying unit that is mounted to the frame.

6. The media conveying device of claim 5, wherein the both end portions in the length direction of the supporting point shaft are inserted through frame hole portions that are formed in the frame, and, due to the reaction force, are pushed against distal end side end surfaces which are the distal end side end surfaces of the frame hole portions in the direction of the reaction force.

7. The media conveying device of claim 5, wherein position restricting portions, that are the supporting point shaft abutment portions, that are electrically conductive and that project-out from the frame toward the supporting point shaft, are provided at a distal end side which is the distal end side of the supporting point shaft in the direction of the reaction force, and the supporting point shaft is pushed, by the reaction force, against distal end side end surfaces which are the distal end side end surfaces of the position restricting portions in a direction of the pushing force.

8. The media conveying device of claim 1, wherein the conveying guide and the frame are individual components such that the conveying guide and the frame are separable from each other.

9. A media processing device comprising:

an operation section that receives operations relating to a paper-sheet-like media;

a conveying path that conveys the media along a surface direction in accordance with operation of the operation section;

a conveying guide that is electrically non-conductive, and that forms one side surface of the conveying path, and that has an internal space;

a frame that is electrically conductive and holds the conveying guide;

driving rollers;

pushing rollers provided in the internal space of the conveying guide, the pushing rollers conveying the media, by nipping the media between the pushing rollers and the driving rollers, which face the pushing rollers with the conveying path therebetween, and by rotating;

a pushing roller urging portion that applies a pushing force that urges the pushing rollers toward the driving rollers; and a supporting point shaft that is electrically conductive, and whose position in a direction, that is substantially orthogonal to a length direction of the supporting point shaft and a direction of the pushing force, is positioned by the conveying guide in vicinities of both end portions of the supporting point shaft in the length direction, the supporting point shaft supports the pushing roller urging portion in a vicinity of a central portion of the supporting point shaft in the length direction, and that abuts supporting point shaft abutment portions of the frame by receiving a reaction force that arises in a direction of separating from the conveying path in accordance with the pushing force.

10. The media processing device of claim 9, wherein the conveying guide and the frame are individual components such that the conveying guide and the frame are separable from each other.

11. The media processing device of claim 9, wherein:

the conveying guide, the pushing rollers, the pushing roller urging portion, and the supporting point shaft are connected together to form an integral unit and form a conveying unit that is mounted to the frame, and the supporting point shaft is fixed to the conveying guide due to the vicinities of the both end portions in the length direction being inserted through guide hole portions that are formed in the conveying guide, and due to distal end side end portions of the supporting point shaft in said direction, which is substantially orthogonal to the length direction of the supporting point shaft and the direction of the pushing force, and a direction opposite said direction, which is substantially orthogonal to the length direction of the supporting point shaft and the direction of the pushing force, contacting the guide hole portions due to a distal end side end component of the reaction force.

* * * * *